US011818533B2

(12) United States Patent
Li et al.

(10) Patent No.: US 11,818,533 B2
(45) Date of Patent: Nov. 14, 2023

(54) LOUDSPEAKER

(71) Applicant: SHENZHEN SHOKZ CO., LTD., Guangdong (CN)

(72) Inventors: Chaowu Li, Shenzhen (CN); Yongjian Li, Shenzhen (CN)

(73) Assignee: SHENZHEN SHOKZ CO., LTD., Shenzhen (CN)

( * ) Notice: Subject to any disclaimer, the term of this patent is extended or adjusted under 35 U.S.C. 154(b) by 0 days.

(21) Appl. No.: 17/449,488

(22) Filed: Sep. 30, 2021

(65) Prior Publication Data

US 2022/0021960 A1 Jan. 20, 2022

Related U.S. Application Data

(63) Continuation of application No. 17/037,628, filed on Sep. 29, 2020, now Pat. No. 11,166,094, which is a (Continued)

(30) Foreign Application Priority Data

Jan. 5, 2019 (CN) ..... 201910009927.4

(51) Int. Cl.
*H04R 25/00* (2006.01)
*H04R 1/10* (2006.01)
(Continued)

(52) U.S. Cl.
CPC ..... *H04R 1/105* (2013.01); *H04R 1/023* (2013.01); *H04R 1/026* (2013.01); *H04R 1/1008* (2013.01);
(Continued)

(58) Field of Classification Search
CPC ..... H04R 5/033; H04R 5/04; H04R 25/552; H04R 2205/041; H04R 2420/07
See application file for complete search history.

(56) References Cited

U.S. PATENT DOCUMENTS 3,906,170 A * 9/1975 Guice ..... H04R 25/65 381/322
4,296,829 A * 10/1981 Pedersen ..... H04R 25/48 181/129
(Continued)

FOREIGN PATENT DOCUMENTS

CN 102497612 A 6/2012
CN 109660901 A 4/2019
(Continued)

OTHER PUBLICATIONS

International Search Report in PCT/CN2019/102392 dated Nov. 21, 2019, 7 pages.
(Continued)

*Primary Examiner* — Amir H Etesam
(74) *Attorney, Agent, or Firm* — METIS IP LLC

(57) ABSTRACT

The embodiments of present disclosure disclose a loudspeaker. The loudspeaker may include an ear hook including a first plug end and a second plug end. The ear hook may be surrounded by a protection sleeve, and the protection sleeve may be made of an elastic waterproof material. The loudspeaker may include an earphone core housing configured to accommodate the earphone core, and the earphone core housing may be fixed to the first plug end through plugging, and may be elastically abutted against the protection sleeve elastically. The loudspeaker may include a circuit housing configured to accommodate a control circuit or a battery. The circuit housing may be fixed to the second plug end through plugging.

20 Claims, 23 Drawing Sheets

Related U.S. Application Data continuation of application No. PCT/CN2019/102392, filed on Aug. 24, 2019.

(51) Int. Cl.

| | |
|---|---|
| ***H04R 1/02*** | (2006.01) |
| ***H04R 31/00*** | (2006.01) |
| ***H04R 9/02*** | (2006.01) |
| ***H04R 1/44*** | (2006.01) |

(52) U.S. Cl.

CPC ..... *H04R 1/1041* (2013.01); *H04R 1/1058* (2013.01); *H04R 1/1091* (2013.01); *H04R 1/44* (2013.01); *H04R 9/025* (2013.01); *H04R 31/00* (2013.01); *H04R 1/1016* (2013.01); *H04R 1/1025* (2013.01); *H04R 2201/10* (2013.01); *H04R 2460/13* (2013.01)

(56) References Cited

U.S. PATENT DOCUMENTS

| | | | | |
|---|---|---|---|---|
| 10,638,211 | B2 | 4/2020 | Wen et al. | |
| 10,863,807 | B1 * | 12/2020 | Wright ..... | A45C 11/00 |
| 2005/0141730 | A1 | 6/2005 | Murphy | |
| 2017/0318369 | A1 | 11/2017 | Wang | |
| 2021/0127193 | A1 | 4/2021 | Li et al. | |
| 2021/0329360 | A1 | 10/2021 | Li et al. | |
| 2021/0329371 | A1 | 10/2021 | Li et al. | |

FOREIGN PATENT DOCUMENTS

| | | | |
|---|---|---|---|
| CN | 109714687 | A | 5/2019 |
| CN | 209184801 | U | 7/2019 |
| CN | 209267804 | U | 8/2019 |

OTHER PUBLICATIONS

Written Opinion in PCT/CN2019/102392 dated Nov. 21, 2019, 10 pages.

* cited by examiner

LOUDSPEAKER

CROSS-REFERENCE TO RELATED APPLICATIONS

This application is continuation of U.S. patent application Ser. No. 17/037,628, filed on Sep. 29, 2020, which is a continuation of International Application No. PCT/CN2019/102392, filed on Aug. 24, 2019, which claims priority to Chinese Patent Application No. 201910009927.4, filed on Jan. 5, 2019, the entire contents of which are hereby incorporated by reference.

TECHNICAL FIELD

The present disclosure generally relates to a loudspeaker (e.g., a MP3 player), and more particularly, relates to a waterproof loudspeaker.

BACKGROUND

In general, people can hear sound since air transmits vibrations to the eardrum through the external auditory canal, and the vibrations transmitted to the eardrum drives auditory nerves to perceive sound. At present, earphones are widely used in people's daily lives. For example, a user may use an earphone to play music and answer telephone calls. Earphones have become an important part of people's daily lives. Ordinary earphones may no be applicable in some special scenarios (for example, swimming, rainy days, outdoor, etc.). Earphones with waterproof functions and better sound quality are more popular with consumers. Therefore, it is desirable to provide a loudspeaker with a waterproof function and being convenient for manufacture and assembly.

SUMMARY

The present disclosure embodiment provides a loudspeaker, the loudspeaker may include an ear hook, including a first plug end and a second plug end, the ear hooks may be surrounded by a protection sleeve, the protection sleeve may be made of an elastic waterproof material; an earphone core housing configured to accommodate an earphone core, the earphone core housing may be fixed to the first plug end through plugging, and may be elastically abutted against the protection sleeve; and a circuit housing configured to accommodate a control circuit or a battery, the circuit housing may be fixed to the second plug end through plugging, the control circuit or the battery may drive the earphone core to vibrate to generate sound, and the sound may include at least two resonance peaks.

In some embodiments, the ear hook further may include: an elastic metal wire; a lead wire and a fixing sleeve, the fixing sleeve may fixe the lead wire to the elastic metal wire; the protection sleeve may be formed on a periphery of the elastic wire, the wire, the fixing sleeve, the first plug end, and the second plug end by injection molding.

In some embodiments, the first plug end and the second plug end may be formed at two ends of the elastic metal wire by injection molding, respectively, a first cable-routing channel and a second cable-routing channel may be set on the first plug end and the second plug end, respectively, and the lead wire may extend along the first cable-routing channel and the second cable-routing channel.

In some embodiments, the lead wire may be set in the first cable-routing channel and the second cable-routing channel in a threading manner.

In some embodiments, the first cable-routing channel may include a first routing groove and a first routing hole that connects the first routing groove and an outer end surface of the first plug end, the lead wire may extend along the first routing groove and the first routing hole, and may be exposed on the outer end surface of the first plug end; and the second cable-routing channel may include a second routing groove and a second routing hole that connects the second routing groove and the outer end surface of the first plug end, the lead wire may extend along the second routing groove and the second routing hole, and may be exposed on an outer end surface of the second plug end.

In some embodiments, there may be at least two fixing sleeves, and the fixing sleeves may be spaced at intervals along the elastic wire.

In some embodiments, a first plug hole may be set on the earphone core housing connecting the outer end surface of the earphone core housing, a stop block may be set on an inner side wall of the first plug hole, and the first plug hole may be connected to the first plug end through clamping.

In some embodiments, the first plug end may include an insertion portion and two elastic hooks; the insertion portion may be at least partially inserted into the first plug hole and abuts against an outer surface of the stop block; two elastic hooks may be disposed on a side of the insertion portion facing the inside of the earphone core housing, the two elastic hooks may be brought close to each other under an action of an external thrust and the stop block, and elastically restored to be stuck on the inside surface of the stop block after passing through the stop block, implementing the connection between the earphone core housing and the first plug end.

In some embodiments, the insertion portion may be partially inserted into the first plug hole, and an exposed portion of the insertion portion has in a stair-step shape, forming an annular platform spaced apart from the outer end surface of the earphone core housing.

In some embodiments, the protection sleeve further may extend to a side of the annular platform facing the outer end surface of the earphone core housing, and may elastically abut against the earphone core housing for sealing when the earphone core housing is fixed to the first plug end through plugging.

In some embodiments, the loudspeaker further may include a fixing member; a second plug hole may be set on the circuit housing, and the second plug end may be at least partially inserted into the second plug hole and connects the second plug hole through the fixing member.

In some embodiments, the second plug end may include a groove being perpendicular to the insertion direction of the second plug hole, and a through hole corresponding to a position of the groove may be set on a first side wall of the circuit housing; the fixing member may include two pins disposed in parallel and a connecting portion for connecting the pins; and the pins may be inserted into the groove from the outside of the circuit housing through the through hole, realizing the fixing of the circuit housing and the second plug end through plugging.

In some embodiments, the ear hook may further include a housing protector integrally formed with the protection sleeve, and the housing protector may be cladded on a periphery of the circuit housing in a sleeved manner.

In some embodiments, the earphone core may include at least a composite vibration apparatus including of a vibration board and a second vibration conducting sheet, and the composite vibration apparatus may generate the two resonance peaks.

In some embodiments, the earphone core may further include at least one voice coil and at least one magnetic circuit system; the voice coil may be physically connected to the vibration board, and the magnetic circuit system may be physically connected to the second vibration conducting sheet.

In some embodiments, a stiffness coefficient of the vibration board may be greater than a stiffness coefficient of the second vibration conducting sheet.

In some embodiments, the earphone core further may include a first vibration conducting sheet; the first vibration conducting sheet may be physically connected to the composite vibration apparatus; the first vibration conducting sheet may be physically connected to the earphone core housing; the first vibration conducting sheet may generate another resonance peak.

In some embodiments, both the two resonance peaks may be within a frequency range audible to the human ear.

In some embodiments, the earphone core housing may further include at least one contact surface, and the contact surface may be at least partially in direct or indirect contact with a user; and the contact surface may have a gradient structure, distributing pressure on the contact surface unevenly.

In some embodiments, the gradient structure may include at least one convex or at least one groove.

In some embodiments, the gradient structure may be located at the center or edge of the contact surface.

In some embodiments, the earphone core housing may further include at least one contact surface, and the contact surface may be at least partially in direct or indirect contact with a user; the contact surface may include at least a first contact surface region and a second contact surface region, and the degree of convexity of the second contact surface region may be greater than that the degree of convexity of the first contact surface region.

In some embodiments, the first contact surface region may include a sound guiding hole, the sound guiding hole may guide the sound wave inside the earphone core housing to an outside of the earphone core housing, superimposing the sound of sound wave generated by the vibration of the earphone core housing to reduce a sound leakage.

In some embodiments, the first contact surface region and the second contact surface region may be made of plastics including silica gel, rubber, or plastic.

In some embodiments, the loudspeaker may include the loudspeaker and a key module; the key module may be located on the earphone core housing or the circuit housing, and may be used for controlling the loudspeaker.

In some embodiments, the loudspeaker may include the loudspeaker and indicator light; the indicator light may be located on the earphone core housing or the circuit housing, and may be used to display a status of the loudspeaker.

BRIEF DESCRIPTION OF THE DRAWINGS

The present disclosure is further described in terms of exemplary embodiments below. These exemplary embodiments are described in detail with reference to the drawings. These embodiments are not restrictive. In some embodiments, a same number may indicate a same structure, wherein.

DETAILED DESCRIPTION

Figure 1:
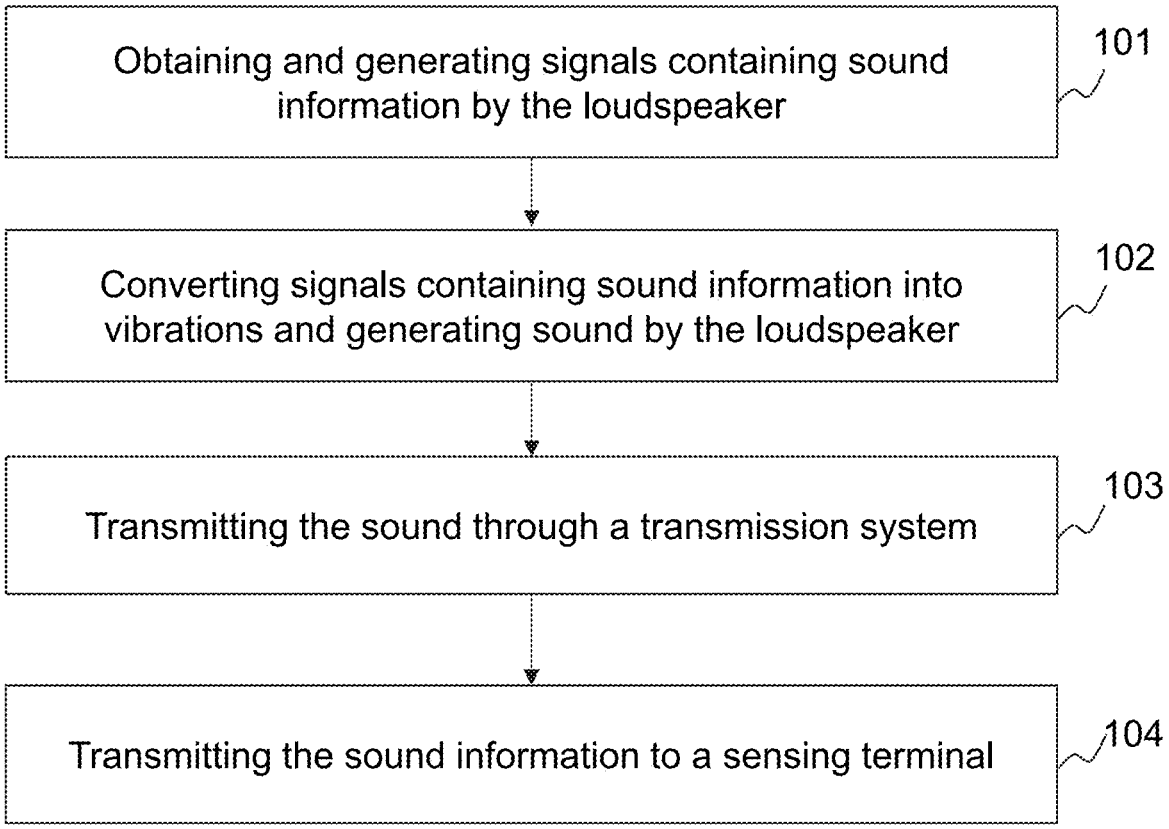
FIG. 1 is an exemplary process illustrating a loudspeaker causes auditory senses in a human ear.

In order to illustrate the technical solutions related to the embodiments of the present disclosure, brief introduction of the drawings referred to in the description of the embodiments is provided below. Obviously, drawings described below are merely some examples or embodiments of the present disclosure. For those skilled in the art, without further creative efforts, may apply the present disclosure to other similar scenarios according to these drawings. It should be understood that the exemplary embodiments are provided merely for better comprehension and application of the present disclosure by those skilled in the art, and not intended to limit the scope of the present disclosure. Unless obviously obtained from the context or the context illustrates otherwise, the same numeral in the drawings refers to the same structure or operation.

As used in the present disclosure and the appended claims, the singular forms "a," "an," and "the" may be intended to include plural referents unless the content clearly dictates otherwise. In general, the terms "comprise" and "include" merely prompt to include steps and elements that have been clearly identified, and these steps and elements do not constitute an exclusive listing, the methods or devices may also include other steps or elements. The term "based on" means "based at least in part on". The term "one embodiment" means "at least one embodiment". The term "another embodiment" means "at least one other embodiment". Related definitions of other terms will be provided in the descriptions below. In the following, without loss of generality, in describing sound conduction related technologies in the present disclosure, terms of "playing device", "loudspeaker", "loudspeaking device", or "hearing-aid" will be used. This description is just a form of sound conduction application. For those skilled in the art, "player", "playing device", "loudspeaker", "loudspeaking device" or "hearing-aid" may also be replaced with other similar words. In fact, the various implementations in the present disclosure may be easily applied to other devices. For example, for those skilled in the art, after understanding basic principles of the loudspeaker, it is possible to make various modifications and alterations in the form and details of the specific methods and steps of implementing the loudspeaker without departing from this principle. In particular, ambient sound pick up and processing functions may be added to the loudspeaker, so that the loudspeaker may implement the function of a hearing-aid. For example, in a case of using a bone conduction speaker, a sensor such as a microphone that picks up ambient sound of the user/wearer may be added. The ambient sound processed using a certain algorithm (or an electrical signal) may be transmitted to the bone conduction speaker. That is, the bone conduction speaker may be modified and have the function of picking up ambient sound. The ambient sound may be processed and transmitted to the user/wearer through the bone conduction speaker, thereby implementing the function of a bone conduction hearing-aid. Merely by way of example, the certain algorithm mentioned above may include noise cancellation, automatic gain control, acoustic feedback suppression, wide dynamic range compression, active environment recognition, active noise reduction, directional processing, tinnitus processing, multichannel wide dynamic range compression, active howling suppression, volume control, or the like, or any combination thereof.

FIG. 1 is an exemplary process illustrating a loudspeaker causes auditory senses in a human ear. The loudspeaker may transmit sound to an auditory system of the user/wearer through bone conduction or air conduction, thereby generating auditory senses. As shown in FIG. 1, the process of causing auditory senses in a human ear may mainly include one or more of the following operations:

In 101, obtaining or generating signals containing sound information by the loudspeaker. In some embodiments, sound information may refer to videos or audio files with specific data formats, or data or files that may be eventually converted into sound in a specific way. In some embodiments, the signal containing the sound information may be retrieved from a storage unit of the loudspeaker, or an information generation, storage, or a transmission system other than the loudspeaker. The sound signals herein may not be limited to electrical signals. The sound signals may also include optical signals, magnetic signals, mechanical signals, etc. In principle, as long as a signal contains sound information for generating sound, the signal may be determined as a sound signal. In some embodiments, the sound signal may be originated from one signal source, or a plurality of signal sources. The plurality of signal sources may be correlated or irrelevant to each other. In some embodiments, the manner in which the sound signals are transmitted or generated may be wired or wireless, in real-time or delayed manner. For example, the loudspeaker may receive the electrical signals containing sound information in a wired or wireless manner, or obtain data from a storage medium directly and generate the sound signals based on the obtained data. Taking bone conduction technology as an example, a component facilitating sound acquisition may be added to the bone conduction speaker. By picking up sound in the environment, mechanical vibrations of the sound may be converted into electrical signals, and the electrical signals that meet specific requirements may be obtained after being processed by an amplifier. Exemplary wired connections may include but not limited to a metal cable, an optical cable, or a metal and optical hybrid cable, such as a coaxial cable, a communication cable, a flexible cable, a spiral cable, a non-metal sheathed cable, and a metal sheathed cable, a multi-core cable, a twisted-pair cable, a ribbon cable, a shielded cable, a telecommunication cable, a double-stranded cable, a parallel twin-core conductor, a twisted pair, etc. The examples described above are merely for convenience of explanation. The wired connection media may be of other types, such as other electrical or optical signal transmission carriers.

The storage devices/storage units described herein may include storage devices on a storage system such as a direct attached storage, a network attached storage, and a storage area network. Exemplary storage devices may include but not limited to storage devices of ordinary types such as a solid-state storage device (e.g., solid state disk, hybrid hard disk, etc.), a mechanical hard disk, a USB flash memory, a memory stick, a memory card (e.g., CF, SD, etc.), other drivers (e.g. CD, DVD, HD DVD, Blu-ray, etc.), a random access memory (RAM), a read-only memory (ROM), etc. The RAM may include but not limited to a dekatron, a selectron, a delay line memory, Williams tubes, a dynamic random access memory (DRAM), a static random access memory (SRAM), a thyristor random access memory (T-RAM), a zero capacitor random access memory (Z-RAM), etc. The ROM may include but not limited to a bubble memory, a twistor memory, a film memory, a plated wire memory, a magnetic-core memory, a drum memory, a CD-ROM, a hard disk, a tape, a non-volatile random access memory (NVRAM), a phase-change memory, a magneto-resistive random access memory, a ferroelectric random access memory, a non-volatile SRAM, flash memory, an electrically erasable programmable read-only memory, an erasable programmable read-only memory, a programmable read-only memory, a mask ROM, a floating gate random access memory, a Nano random access memory, a racetrack memory, a resistive random access memory, a programmable metallization unit, etc. The storage devices/storage units mentioned above may be a listing of examples. The storage devices/storage units may include storage devices of other types, which is limited in the present disclosure.

In 102, converting signals containing sound information into vibrations and generating sound by the loudspeaker. The generation of the vibrations may be accompanied by a conversion of energy, the loudspeaker may use a specific transducer to convert the signals to mechanical vibrations. The conversion process may involve a coexistence and interconversion of energy of various types. For example, electrical signals may be directly converted into mechanical vibrations through a transducer, and the sound may be generated. As another example, the sound information may be included in optical signals, and a specific transducer may implement the process of converting the optical signals into vibrations. Energy of other types that may coexist and interconverted during the working process of the transducer may include thermal energy, magnetic field energy, etc. In some embodiments, the energy conversion manner of the transducer may include but not limited to, a moving coil type, an electrostatic type, a piezoelectric type, a moving iron type, a pneumatic type, and an electromagnetic type. A frequency response range and sound quality of the loudspeaker may be affected by energy transduction methods of different types and performances of various physical components in the transducer. For example, in a moving-coil transducer, a wound cylindrical coil may connect to a vibration board, and a coil driven by a signal current may drive the vibration board to generate sound in a magnetic field. Stretches, shrinks of the vibration board material, deformations, sizes, shapes and fixed manner of folds, and magnetic densities of permanent magnets may have great impacts on the sound quality of the loudspeaker.

The term "sound quality" as used herein may reflect the quality of the sound, and may refer to a fidelity of the sound after the sound is processed, transmitted, etc. In an acoustic device, the sound quality may include an intensity and amplitude of the sound, a frequency of the sound, and an overtone or harmonic components of the sound. There may be measurement methods and evaluation criteria for evaluating the sound quality objectively, and methods that evaluate various attributes of the sound quality by combining different elements of the sound and subjective feelings. Therefore, the generation, transmission and reception of the sound may affect the sound quality to a certain extent.

In 103, transmitting the sound through a transmission system. In some embodiments, the transmission system may refer to a substance that may transmit vibrations containing the sound information, such as skulls, bone labyrinths, inner ear lymph fluid, and spiral organs of humans and/or animals, as another example, media that transmits the sound (for example, air, liquid). In order to explain the process of transmitting the sound information through the transmission system, the bone conduction speaker may be taken as an example. The bone conduction speaker may transmit the sound waves (vibration signals) transformed from electrical signals directly through bones to the auditory center of the user/wearer. In addition, the sound waves may be transmitted to the auditory center by means of air conduction. Details regarding the air conduction may be described elsewhere in the present disclosure.

In 104, transmitting the sound information to a sensing terminal. Specifically, the sound information may be transmitted to the sensing terminal through the transmission system. In an application scenario of the loudspeaker, the loudspeaker may pick up or generate a signal containing sound information, convert the sound information into sound vibrations through a transducer, and transmit the sound vibrations to the sensing terminal through the transmission system. Then the user/wearer may hear the sound. Without loss of generality, the subjects described above for the sensing terminal, the auditory system, the sensory organs, etc., may be humans and animals with auditory systems. It should be noted that the following descriptions of the use of the loudspeaker by a person does not constitute a limitation on the use of the loudspeaker. Similar descriptions may also be applied to animals.

The above descriptions of the general working process of the loudspeaker is merely a specific example, and should not be taken as the only feasible implementation solution. Obviously, for a person skilled in the art, after understanding the basic principle of the loudspeaker, it may be possible to make various modifications and alterations in the form and detail of the specific manner and steps of implementing the working process of the loudspeaker without departing from this principle, but these modifications and alterations are still within the scope described above. For example, between the operation 101 and the operation 102, a signal correction or enhancement operation may be performed. In the signal correction or enhancement operation, the signals obtained in operation 101 may be strengthened or modified according to a specific algorithm or parameter. Furthermore, between the operation 102 and the operation 103, an additional vibration strengthening or correction operation may be performed.

Figure 2:
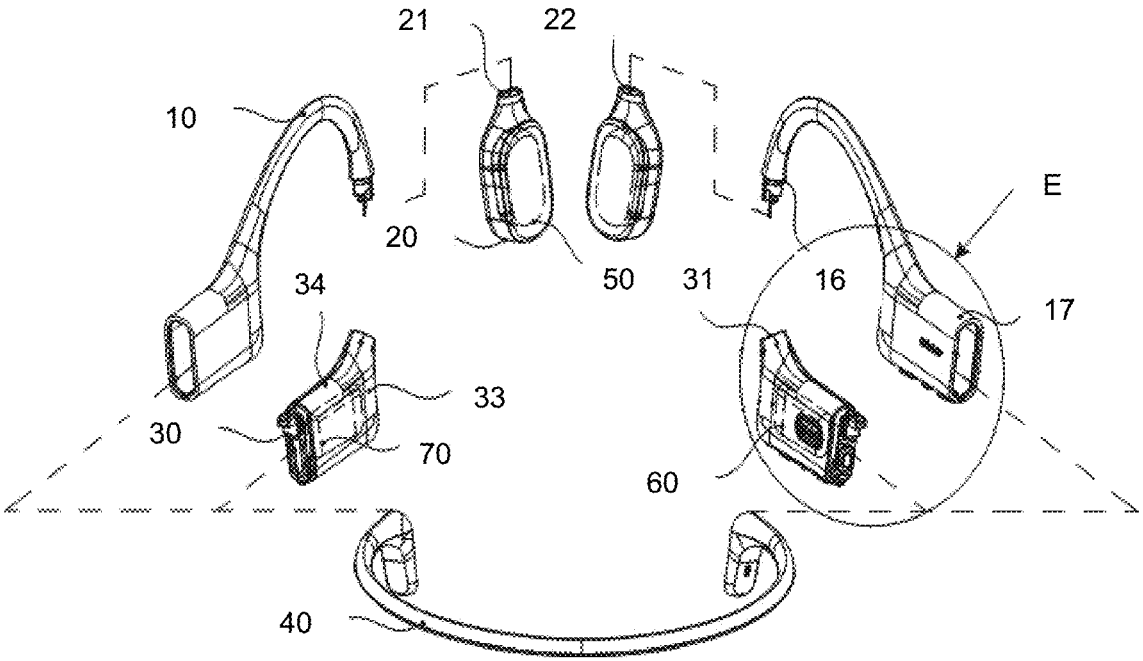
FIG. 2 is a schematic diagram illustrating an explosion structure of an MP3 player according to some embodiments of the present disclosure.
Figure 3:
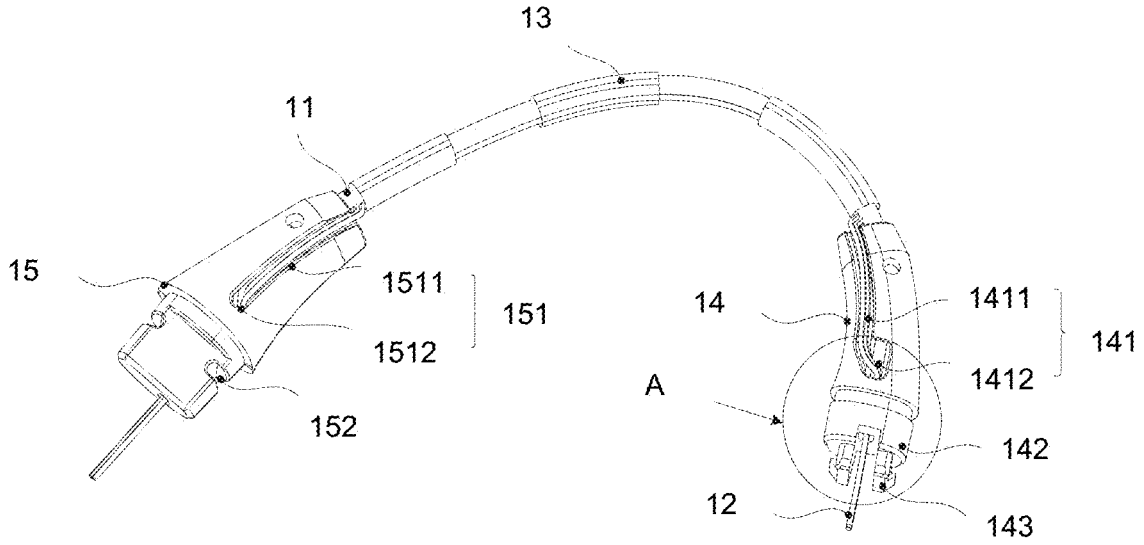
FIG. 3 is a schematic diagram illustrating a partial structure of an ear hook in an MP3 player according to some embodiments of the present disclosure.
Figure 4:
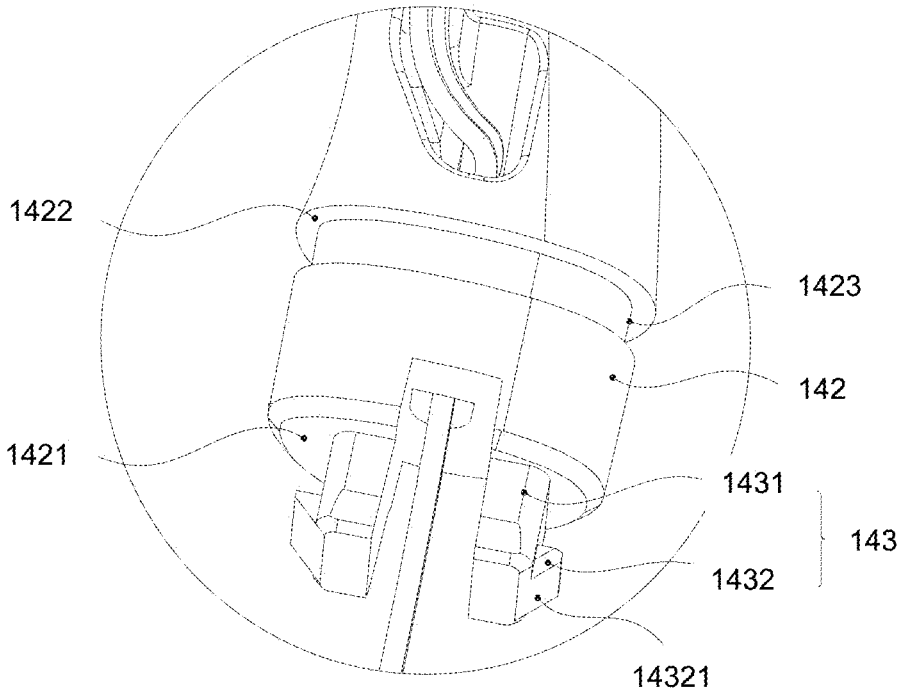
FIG. 4 is a partial enlarged view of part A in FIG. 3.

The loudspeaker in the present disclosure may include but not limited to headphones, MP3 players, and hearing-aids. In the following embodiments of the present disclosure, an MP3 player may be taken as an example of the loudspeaker. FIG. 2 is a schematic diagram illustrating an explosion structure of an MP3 player according to some embodiments of the present disclosure, FIG. 3 is a schematic diagram illustrating a partial structure of an ear hook in an MP3 player according to some embodiments of the present disclosure, and FIG. 4 is a partial enlarged view of part A in FIG. 3. As shown in FIG. 2, in some embodiments, the MP3 player may include ear hooks 10, earphone core housings 20, a circuit housing 30, rear hooks 40, an earphone core 50, a control circuit 60, and a battery 70. The earphone core housings 20 and the circuit housing 30 may be set at both ends of the ear hooks 10, respectively, and the rear hooks 40 may further be set at an end of the circuit housing 30 away from the ear hooks 10. The number of the earphone core housings 20 may be two, which may be used to accommodate different earphone cores, respectively, and the number of the circuit housing 30 may also be two, which are used to accommodate the control circuit 60 and the battery 70, respectively. The two ends of the rear hooks 40 may be connected to the corresponding circuit housing 30, respectively. Among them, the ear hooks 10 may refer to a structure configured to surround and support the MP3 player upon the user's ears when the user wears the MP3 player, and hang the earphone core housings 20 and earphone core 50 at a predetermined position of the user's ear.

In conjunction with FIG. 2, FIG. 3, and FIG. 4, in some embodiments, the ear hooks 10 may include an elastic metal wire 11, a lead wire 12, a fixing sleeve 13, a plug end 14, and a plug end 15. The plug end 14 and the plug end 15 may be set at both ends of the elastic metal wire 11. In some embodiments, the ear hooks 10 may further include a protection sleeve 16 and a housing protector 17 integrally formed with the protection sleeve 16. The elastic metal wire 11 may be mainly configured to keep the ear hooks 10 in a shape which matches the ears of the user with a certain elasticity, so that a certain elastic deformation may occur according to the ear shape and the head shape of the user when the user wears, so as to adapt to users with different ear shapes and head shapes. In some embodiments, the elastic metal wire 11 may be made of a memory alloy with a good deformation recovery ability, so that even if the ear hooks 10 is deformed due to an external force, it may still return to its original shape when the external force is removed, so that it may continue to be used by users, thereby extending the lifetime of the MP3 player. In other embodiments, the elastic wire 11 may also be made of a non-memory alloy. The lead 12 may be configured to establish electrical connection with the earphone core 50 and the control circuit 60, the battery 70, etc., so as to provide power supply and data transmission for the work of the earphone core 50.

The fixing sleeve 13 may be configured to fix the lead wire 12 on the elastic wire 11. In this embodiment, there may be at least two fixing sleeves 13 which may be spaced at intervals along a direction of the elastic wire 11 and the lead wire 12, and the lead wire 12 may be fixed on the elastic wire 11 by being wrapped around the lead wire 12 and the periphery of the elastic wire 11 by the fixing sleeves 13.

In some embodiments, the plug end 14 and plug end 15 may be made of hard material, such as plastic. In some embodiments, in the process of manufacturing the plug end 14 and the plug end 15, the two plug ends may be formed at both ends of the elastic metal wire 11 in an injection molding manner. In some embodiments, the injection molding may also be performed on the plug end 14 and plug end 15, separately, and the connection holes corresponding to the ends of the elastic wire 11 may be reserved during the injection molding, so that after injection molding is completed, the plug end 14 and plug end 15 may be connected to the corresponding ends of the elastic wire 11 through the connection holes, respectively, or fixed by means of bonding.

It should be noted that, in this embodiment, the plug end 14 and the plug end 15 may not be directly formed on the periphery of the lead wires 12 by injection molding, and keep away from the lead wires 12 during injection molding. Specifically, when the plug end 14 and the plug end 15 are injection-molded, the lead wires 12 located at both ends of the elastic metal wire 11 may be fixed away from the positions of the plug end 14 and the plug end 15, a first cable-routing channel 141 and a second cable-routing channel 151 may be set on the plug end 14 and the plug end 15, respectively, so that after the injection molding is completed, the lead wires 12 may extend along the first cable-routing channel 141 and the second cable-routing channel 151. Specifically, after the first cable-routing channel 141 and the second cable-routing channel 151 are formed, the lead wires 12 may be put in the first cable-routing channel 141 and the second cable-routing channel 151 in a threading manner. In some embodiments, the plug end 14 and plug end 15 may be directly injection molded on the periphery of the lead wires 12 according to actual situations, which is not limited here.

In some embodiments, the first cable-routing channel 141 may include a first routing groove 1411 and a first routing hole 1412 that connects the first routing groove 1411. The first routing groove 1411 may connect with the side wall surface of the plug end 14. One end of the first routing hole 1412 may connect with one end of the first routing groove 1411, and the other end of the first routing hole 1412 may connect with the outer end surface of the plug end 14. The lead wires 12 at the plug end 14 may extend along the first routing groove 1411 and the first routing hole 1412, and be exposed on the outer end face of the plug end 14 to further connect with other structures.

In some embodiments, the second cable-routing channel 151 may include a second routing groove 1511 and a second routing hole 1512 that connects the second routing groove 1511. The second routing groove 1511 may connect with the side wall surface of the plug end 15. One end of the second routing hole 1512 may connect with one end of the second routing groove 1511, and the other end of the second routing hole 1512 may connect with the outer end surface of the plug end 15. The lead wires 12 at the plug end 15 may extend along the second routing groove 1511 and the second routing hole 1512, and be exposed on the outer end surface of the plug end 15 to further connect with other structures.

In some embodiments, the outer end face of the plug end 14 may refer to an end face of the plug end 14 away from the plug end 15; accordingly, the outer end face of plug end 15 may refer to an end face of the plug end 15 away from the plug end 14.

In some embodiments, the protection sleeve 16 may be injection-molded on the peripheries of the elastic metal wire 11, the lead wires 12, the fixing sleeve 13, the plug end 14, and the plug end 15, so that the protection sleeve 16 may be fixedly to the elastic wire 11, the lead wires 12, the fixing sleeve 13, the plug end 14, and the plug end 15, instead of being sleeved on the periphery of the elastic wire 11, the plug end 14, and the plug end 15 after the protection sleeve 16 is formed by injection molding separately, which may simplify the manufacturing and assembly process. In this way, the protection sleeve 16 may be fixed more tightly and stably.

In some embodiments, when the protection sleeve 16 is molded, a housing protector 17 set on the side near the plug end 15 may be integrally molded with the protection sleeve 16 at the same time. In some embodiments, the housing protector 17 and the protection sleeve 16 may be integrated into a whole. The circuit housing 30 may be connected to the end of the ear hooks 10 by plugging with the plug end 15, and the housing protector 17 may be further cladded on the periphery of the circuit housing 30 in a sleeved manner.

Specifically, the manufacture of the ear hooks 10 of an MP3 player may be implemented through the following operations:

In S101: the conductive lead wires 12 on the elastic metal wire 11 may be fixed using a fixing sleeve 13, and injection molding positions may be reserved at both ends of the elastic metal wire 11. Specifically, the elastic metal wire 11 and the lead wires 12 may be disposed together in a preset manner, such as in a side by side manner, and the fixing sleeve 13 may be further sleeved on the periphery of the lead wires 12 and the elastic metal wire 11, so that the lead wires 12 may be fixed on the elastic metal wire 11. Since both ends of the elastic metal wire 11 also need to be inject-molded with the plug end 14 and the plug end 15, when the lead wires are fixed, the two ends of the elastic metal wire 11 may not be completely wrapped by the fixing sleeve 13, and corresponding injection positions may need to be reserved for the injection of the plug end 14 and the plug end 15.

In S102: the plug end 14 and the plug end 15 may be injection-molded on the injection positions at both ends of the elastic metal wire 11, respectively. A first cable-routing channel 141 and a second cable-routing channel 151 may be set on the plug end 14 and the plug end 15, respectively.

In S103: the lead wires 12 may be set to extend along the first cable-routing channel 141 and the second cable-routing channel 151. Specifically, after the plug end 14 and the plug end 15 are molded, the two ends of the lead wires 12 may be inserted into the first cable-routing channel 141 and the second cable-routing channel 151, respectively, manually or by a machine. The portion of the lead wires 12 between the first cable-routing channel 141 and the second cable-routing channel 151 may be fixed on the elastic metal wire 11 by the fixing sleeve 13.

In S104: a protection sleeve 16 may be formed by injection molding on the periphery of the elastic wire 11, the lead wire 12, the fixing sleeve 13, the plug end 14, and the plug end 15.

In some embodiments, when operation S104 is performed, a housing protector 17 that is integrally formed with the protection sleeve 16 on the periphery of the plug end 15 may be further formed by injection molding.

It should be noted that, in some embodiments, it may also be possible that the lead wires 12 may not be set when the fixing sleeve 13 is being installed, and the lead wires 12 may be set after the injections of the plug end 14 and the plug end 15 are completed, the detailed operations may be as follows:

In S201: sleeving the fixing sleeve 13 on the elastic metal wire 11, and reversing an injection position at both ends of the elastic metal wire 11.

In S202: injection-molding the plug end 14 and plug end 15 on the injection positions at both ends of the elastic metal wire 11, respectively. A first cable-routing channel 141 and a second cable-routing channel 151 may be set on the plug end 14 and the plug end 15, respectively.

In S203: threading the lead wires 12 inside the fixing sleeve 13, so as to fix the lead wires 12 to the elastic wire 11 with the fixing sleeve 13, and further set the lead wires 12 to extend along the first cable-routing channel 141 and the second cable-routing channel 151.

It should be noted that, it is possible to avoid the interference of the lead wires 12 when the plug end 14 and the plug end 15 are injection-molded in this way, which benefits the progress of the injection-molding.

It should be noted that, the structures, functions, and formation methods of the elastic wire 11, the lead wires 12, the fixing sleeve 13, the plug end 14, the plug end 15, and the protection sleeve 16 involved in the method in this embodiment may be the same as those in above embodiments. Details may be referred to in the above embodiments, and may not be repeated here.

In some embodiments, the earphone core housings 20 may be configured to accommodate the earphone core 50, and the earphone core 50 may be fixed to the plug end 14 through plugging. The number of both the earphone core 50 and the earphone core housings 20 may be two, which may correspond to the left and right ears of the user, respectively.

In some embodiments, the earphone core housings 20 may be connected to the plug end 14 by means of plugging, snapping, etc. to fix the earphone core housings 20 and the ear hooks 10 together. That is, in this embodiment, the ear hooks 10 and the earphone core housings 20 may be separately molded, and further assembled together instead of directly molding the both together.

In this way, the ear hooks 10 and earphone core housings 20 may be molded separately by using their corresponding molds, instead of using one large mold to integrate the both, so that the size of the mold may be decreased to reduce the difficulty for manufacturing the mold and the difficulty of the injection-molding; in addition, since the ear hooks 10 and the earphone core housings 20 are processed by different molds, during the manufacturing process, when the shape or structure of one of the ear hooks 10 or the earphone core housings 20 needs to be adjusted, it is only necessary to adjust the mold corresponding to the structure, and it is not necessary to adjust the mold of another structure, thereby reducing the manufacture cost. Of course, in other embodiments, the ear hooks 10 and earphone core housings 20 may also be obtained by integral molding according to actual situations.

In some embodiments, the earphone core housings 20 may be provided with plug holes 22 connecting the outer end surface 21 of the earphone core housings 20. The outer end surface 21 of the earphone core housings 20 may refer to the end surface of the earphone core housings 20 facing the ear hooks 10. The plug holes 22 may be configured to provide accommodation space for the plug end 14 of the ear hooks 10 inserted into the earphone core housings 20, so as to further implement the connection and fixing of the plug end 14 and the earphone core housings 20.

Figure 5:
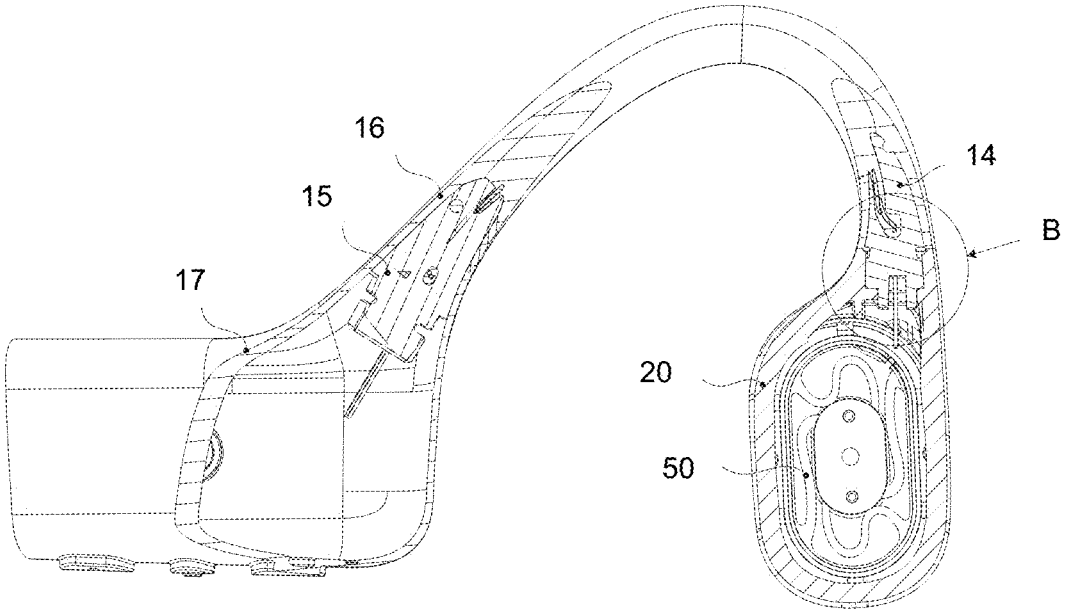
FIG. 5 is a partial cross-sectional view illustrating an MP3 player according to some embodiments of the present disclosure.
Figure 6:
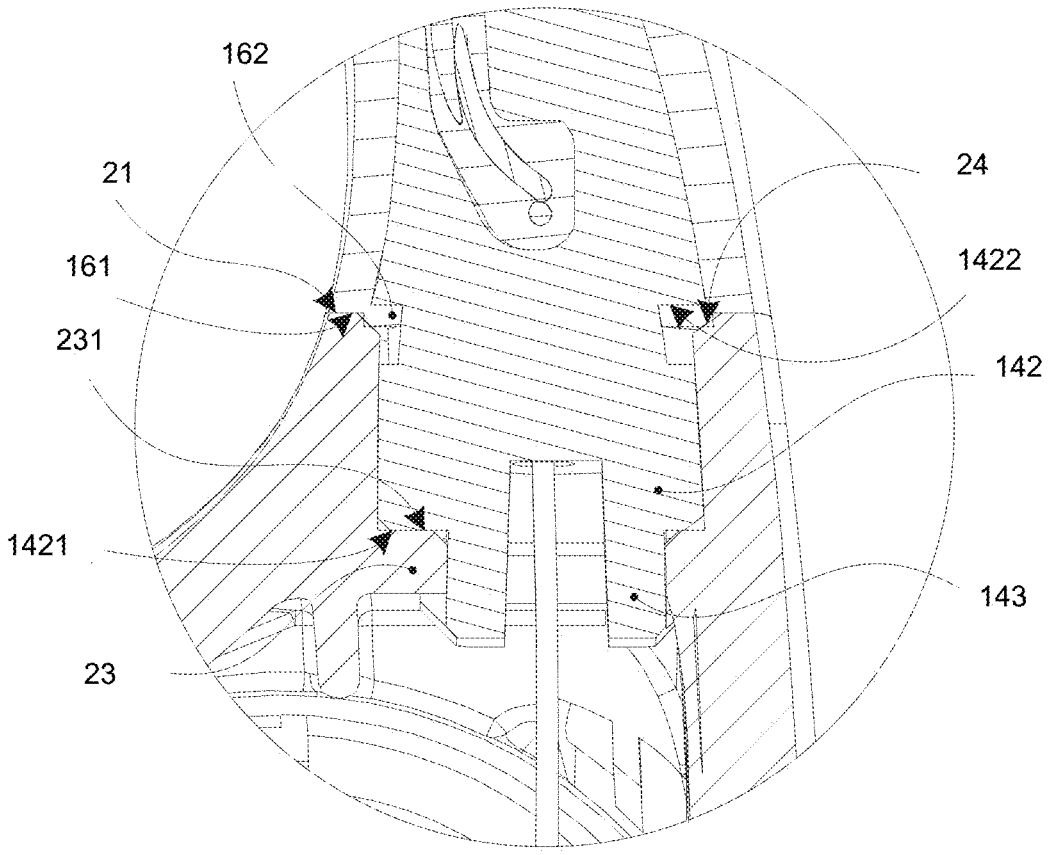
FIG. 6 is a partial enlarged view of part B in FIG. 5.

FIG. 5 is a partial cross-sectional view illustrating an MP3 player according to some embodiments of the present disclosure; FIG. 6 is a partial enlarged view of part B in FIG. 5.

In conjunction with FIG. 2, FIG. 5 and FIG. 6, in some embodiments, the plug end 14 may include an insertion portion 142 and two elastic hooks 143. Specifically, the insertion portion 142 may be at least partially inserted into the plug holes 22, and abut against the outer side surface 231 of the stop block 23. The shape of the outer wall of the insertion portion 142 may match that of the inner wall of the plug holes 22, so that when the insertion portion 142 is at least partially inserted into the plug holes 22, the outer wall of the insertion portion 142 may abut against the inner wall of the plug holes 22.

The outer side 231 of the stop block 23 may refer to a side of the stop block 23 facing the ear hooks 10. The insertion portion 142 may further include an end surface 1421 facing the earphone core housings 20, and the end surface 1421 may match the outer surface 231 of the stop block 23, so that when the insertion portion 142 is at least partially inserted into the plug holes 22, the end surface 1421 of the insertion portion 142 may abut against the outer side surface 231 of the stop block 23.

In some embodiments, two elastic hooks 143 may be spaced apart, side by side and perpendicular to the insertion direction, and symmetrically disposed on a side of the insertion portion 142 facing the inside of the earphone core housings 20. Each elastic hook 143 may include a beam portion 1431 and a hook portion 1432. The beam portion 1431 may be connected to the side of the insertion portion 142 facing the earphone core housings 20, and the hook portion 1432 may be set at an end of the beam portion 1431 away from the insertion portion 142 and extend perpendicular to the insertion direction. Further, each hook portion 1432 may be provided with a transition inclined surface

14321 connecting a side surface parallel to the insertion direction and an end surface remote from the insertion portion 142.

In some embodiments, after the earphone core housings 20 are fixed to the end 14 through plugging, the insertion portion 142 may be partially inserted into the plug hole 22, and an exposed portion of the insertion portion 142 may have a stair-step shape, thereby further forming an annular platform 1422 spaced at intervals from the outer end surface 21 of the earphone core housings 20. The exposed portion of the insertion portion 142 may refer to the portion of the insertion portion 142 exposed to the earphone core housings 20, specifically, may refer to the portion exposed to the earphone core housings 20 and being close to the outer end surface of the earphone core housings 20.

In some embodiments, the annular platform 1422 may be opposite to the outer end surface 21 of the earphone core housings 20, and the interval between the both may refer to the interval along the plugging direction and the interval perpendicular to the plugging direction.

In some embodiments, the protection sleeve 16 may extend to a side of the annular platform 1422 facing the outer end surface 21 of the earphone core housings 20, and fill in the space between the annular platform 1422 and the outer end surface 21 of the earphone core housings 20 when the plug holes 22 of the earphone core housings 20 are fixed to the plug end 14 through plugging, and elastically abut against the earphone core housings 20, which makes it difficult for external liquids to enter the interior of the earphone core housings 20 from the junction between the plug end 14 and the earphone core housings 20, so as to implement the sealing between the plug end 14 and the plug holes 22 to protect the earphone core 50 inside the earphone core housings 20, etc., thereby improving the waterproof effect of the bone conduction MP3 player.

Specifically, in some embodiments, the protection sleeve 16 may form an annular abutment surface 161 on the side of the annular platform 1422 facing the outer end surface of the earphone core housings 20. The annular abutment surface 161 may be an end face of the protection sleeve 16 facing the earphone core housings 20.

The annular platform 1422 may be opposite to the outer end surface 21 of the earphone core housings 20, and the interval between the both may refer to the interval along the plugging direction and the interval perpendicular to the plugging direction.

Further, the protection sleeve 16 may extend to the side of the annular platform 1422 facing the outer end surface 21 of the movement case 20, and filled in the space between the annular platform 1422 and the outer end surface 21 of the movement case 20 when the connection hole 22 and the plug end 14 of the movement case 20 are fixed through plugging, and elastically abuts against the movement case 20, which makes it difficult for external liquids to enter the interior of the earphone core housings 20 from the junction between the plug end 14 and the earphone core housings 20, so as to implement the sealing between the plug end 14 and the plug hole 22 to protect the earphone core 50 inside the earphone core housings 20, etc., thereby improving the waterproof effect of the bone conduction MP3 player.

In some embodiments, the protection sleeve 16 may form an annular abutment surface 161 on the side of the annular platform 1422 facing the outer end surface of the earphone core housings 20. The annular abutment surface 161 may be an end face of the protection sleeve 16 facing the earphone core housings 20.

In some embodiments, the protection sleeve 16 may further include an annular boss 162 located inside the annular abutment surface 161 and protruded from the annular abutment surface 161. Specifically, the annular boss 162 may be formed on a side of the annular abutment surface 161 facing the plug end 14, and protruded from the annular abutment surface 161 in a direction toward the earphone core housings 20. Further, the annular boss 162 may also be directly formed on the periphery of the annular platform 1422 and cover the annular platform 1422.

In some embodiments, the earphone core housings 20 may include a connection slope 24 for connecting the outer end surfaces 21 of the earphone core housings 20 and an inner side wall of the plug hole 22. The connection slope 24 may be a transitional surface between the outer end surface 21 of the earphone core housings 20 and the inner side wall of the plug hole 22. The connection slope 24 and the outer end surface 21 of the earphone core housings 20 and the inner wall of the plug hole 22 are not on a same plane. In some embodiments, the connecting slope 24 may be a flat surface, or may be made into a curved surface or other shapes according to actual needs, which is not limited here.

Specifically, when the earphone core housings 20 and the plug end 14 are fixed through plugging, the annular abutment surface 161 and the annular boss 162 may elastically abut against the outer end surface of the earphone core housings 20 and the connecting slope 24, respectively. It should be noted that, since the outer end surface 21 and the connecting slope 24 of the earphone core housings 20 are not on the same plane, the elastic abutment between the protection sleeve 16 and the earphone core housings 20 may not on the same plane, which makes it difficult for external liquids to enter the earphone core housings 20 from the protection sleeve 16 and the earphone core housings 20 and further enter the earphone core 50, thereby improving the waterproof effect of the MP3 player to protect the internal functional structure, and extending the service life of the MP3 player.

In some embodiments, the insertion portion 142 may further form an annular groove 1423 adjacent to the annular platform 1422 on the side of the annular platform 1422 facing the outer end surface 21 of the earphone core housings 20, wherein the annular boss 162 may be formed in the annular groove 1423.

In some embodiments, one end of the lead wires 12 of the ear hooks 10 located outside the earphone core housings 20 may be put in the second cable-routing channel 151, and further connect the external circuit outside the earphone core housings 20, such as the control circuit 60 and the battery 70 accommodated in the circuit housing 30. The other end of the lead wires 12 may extend along the first cable-routing channel 141 to the outer end surface of the plug end 14, and further enter the earphone core housings 20 through the plug hole 22 with the insertion portion 142.

Figure 7:
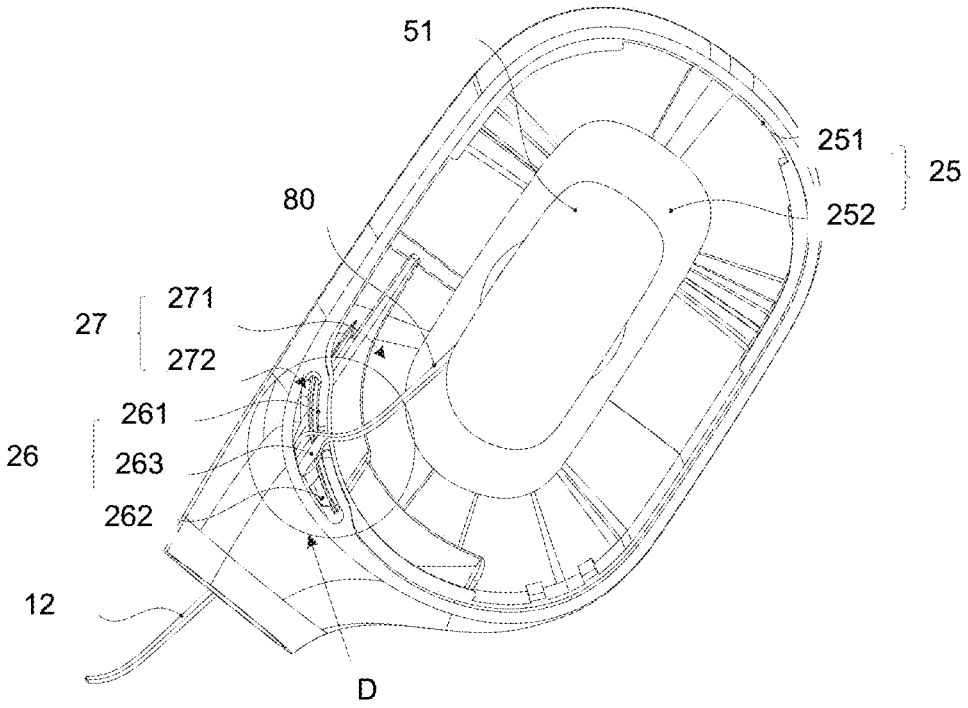
FIG. 7 is a diagram illustrating partial structure of an earphone core housing according to some embodiments of the present disclosure.
Figure 8:
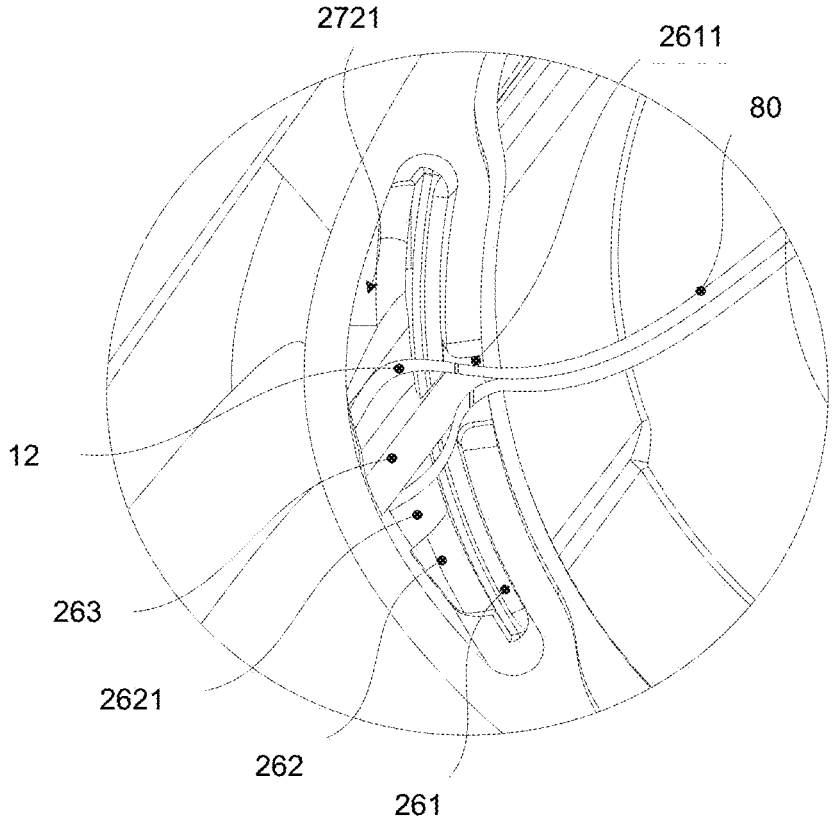
FIG. 8 is a partial enlarged view of part D in FIG. 7.
Figure 9:
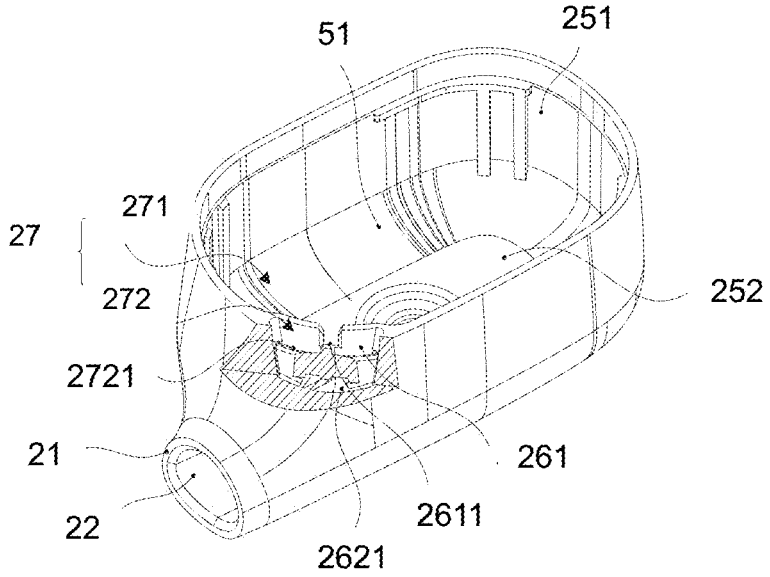
FIG. 9 is a partial cross-sectional view illustrating an earphone core housing according to some embodiments of the present disclosure.

FIG. 7 is diagram illustrating a partial structure of an earphone core housing according to some embodiments of the present disclosure, FIG. 8 is a partial enlarged view of part D in FIG. 7, and FIG. 9 is a partial cross-sectional view illustrating an earphone core housing provided according to some embodiments of the present disclosure.

In conjunction with FIG. 2, FIG. 7, FIG. 8, and FIG. 9, in some embodiments, an earphone core housing 20 may include a main housing 25 and a clapboard component 26. The clapboard component 26 may be located inside the main housing 25, connected to the main housing 25, and further divide the internal space 27 of the main housing 25 into a first receiving space 271 and a second receiving space 272 near the plug hole 22. In some embodiments, the main housing 25 may include a peripheral side wall 251 and a bottom end wall 252 connected to one end surface of the peripheral side wall 251, and the peripheral side wall 251 and the bottom end wall 252 may form an internal space 27 of the main housing 25.

The clapboard component 26 may be located on a side of the main housing 25 near the plug hole 22, and include a side clapboard 261 and a bottom clapboard 262. The side clapboard 261 may be set in a direction perpendicular to the bottom end wall 252, and both ends of the side clapboard 261 may be connected to the peripheral side wall 251, so as to partition the internal space 27 of the main housing 25. The bottom clapboard 262 may be set parallel to or approximately parallel to the bottom end wall 252 and spaced apart, and further connected to the peripheral side wall 251 and the side clapboard 261, respectively, so that the internal space 27 formed by the main housing 25 may be divided into two to form a first accommodation space 271 surrounded by the side clapboard 261, the bottom clapboard 262, the peripheral side wall 251 and the bottom end wall 252 away from the plug hole 22, and a second accommodation space 272 surrounded by the bottom clapboard 262, the side clapboard 261, and the peripheral side wall 251 near the plug hole 22. The second accommodation space 272 may be smaller than the first accommodation space 271. Of course, the clapboard component 26 may also divide the internal space 27 of the main housing 25 in other setting manners, which is not limited here.

In some embodiments, the earphone core may include a functional component 51 which is set in the first accommodation space 271, and may vibrate to generate sound. In some embodiments, the MP3 player may also include a lead wire 80 connected to the functional component 51, and the other end of the wire 80 may be extended from the first accommodation space 271 to the second accommodation space 272.

In some embodiments, the side clapboard 261 may be provided with a routing groove 2611 at a top edge away from the bottom end wall 252, and the routing groove 2611 may connect the first accommodation space 271 and the second accommodation space 272. Further, one end of the lead wires 12 far from the functional component may extend to the second accommodation space 272 via the routing groove.

After the end of the lead 12 far from the circuit housing 30 enters the earphone core housings 20 with the insertion portion 142, it may further extend into the second accommodation space 272 and be electrically connected to the lead wires 80 in the second accommodation space 272 to form a lead path from the first accommodation space 271 to the external circuit via the second accommodation space 272, thereby electrically connecting the functional component 51 to the external circuit located outside the earphone core housings 20 through the lead path.

In some embodiments, a routing hole 2621 may also be set on the bottom clapboard 262. The routing hole 2621 may connect the plug hole 22 and the second accommodation space 272, so that the lead wires 12 entering the earphone core housings 20 from the plug hole 22 may extend to the second accommodation space 272 through the routing hole 2621.

After the lead wires 12 and the lead wires 80 are connected in the second accommodating space 272, the lead wires may be coiled in the second accommodating space 272. Specifically, the lead wires 12 and the lead wires 80 may be connected together by welding, and the functional component 51 may be electrically connected to an external circuit to provide power for the normal operation of the functional component 51 through an external circuit or transmit data to the earphone core 50.

It should be noted that when an MP3 player is being assembled, the lead wires may be longer than the actual demand for easier assembly. However, if the extra lead wires at the earphone core 50 cannot be placed reasonably, it may vibrate to generate abnormal sound when the functional component 51 is working, thereby affecting the sound quality of the MP3 player and the user's listening experience. In this embodiment, a second accommodating space 272 may be separated from the inner space 27 formed by the main housing 25 of the earphone core housings 20 to accommodate the extra lead wires 12 and lead wires 80, thereby avoiding or reducing the influence of the extra wires on the sound generated by the MP3 player due to vibration, so as to improve the sound quality.

In some embodiments, the clapboard component 26 may further include an inner clapboard 263, which further divides the second accommodation space 272 into two sub-accommodation spaces 2721. Specifically, the inner clapboard 263 may be set perpendicular to the bottom end wall 252 of the main housing 25, and connected to the side clapboard 261 and the peripheral side wall 251, respectively, and further extend to the routing hole 2621. Thus, while the second accommodation space 272 is divided into two sub accommodation spaces 2721, the routing hole 2621 may be further divided into two holes, and the two routing holes 2621 may connect the corresponding sub accommodation spaces 2721.

In this embodiment, the number of the lead wires 12 and the lead wires 80 may be two, respectively, and the two lead wires 12 may extend into their respective sub-accommodation spaces 2721 along the corresponding routing hole 2621, respectively. The two lead wires 80 may still enter the second accommodation space 272 together through the routing groove 2611, be separated after the two lead wires 80 enters the second receiving space 272, be welded with the corresponding lead wires 12 in the corresponding sub-accommodation space 2721, respectively, and further be coiled in the corresponding sub-accommodation space 2721.

In some embodiments, the second accommodation space 272 may further be filled with a seal gum. In this way, the lead wires 12 and the lead wires 80 accommodated in the second accommodation space 272 may be further fixed, so as to further reduce the adverse effect on the sound quality caused by the vibrations of the lead wires, thereby improving the sound quality of the MP3 player, while protecting the welding point between the lead wires 12 and the lead wires 80. In addition, the second accommodation space 272 may be sealed to achieve the purpose of waterproof and dustproof.

Referring to FIG. 2 and FIG. 3, in some embodiments, the circuit housing 30 may be fixed with plug end 15 through plugging so as to fix the circuit housing 30 on the end of the ear hooks 10 away from the earphone core housings 20. When the user wears the earphone, the circuit housing 30 accommodating the battery 70 and the circuit housing 30 accommodating the control circuit 60 may correspond to the left and right sides of the user, respectively, both of which may be in different connections with the corresponding plug end 15.

Specifically, the circuit housing 30 may be connected to the plug end 15 by plugging, snapping, or the like. That is, in this embodiment, the ear hooks 10 and the circuit housing 30 may be molded separately, and further assembled together after the molding is completed, instead of directly molding the both together.

In this way, the ear hooks 10 and the circuit housing 30 may be formed separately by using their corresponding molds, instead of using the one large mold to integrate the both, so that the size of the forming mold may be decreased to reduce the difficulty for manufacturing the mold and the difficulty of the injection; in addition, since the ear hooks 10 and the circuit housing 30 are processed by different molds, during the manufacturing process, when the shape or structure of one of the ear hooks 10 or the circuit housing 30 needs to be adjusted, it is only necessary to adjust the mold corresponding to the structure, and it is not necessary to adjust the mold of another structure, thereby reducing the manufacture cost.

In some embodiments, the circuit housing 30 is provided with a plug hole 31, and the shape of the inner surface of the plug hole 31 may match that of at least a part of the outer surface of the plug end 15, so that the plug end 15 may be at least partially inserted into the plug hole 31.

Further, the opposite sides of the plug end 15 may be respectively provided with grooves 152 that are perpendicular to the insertion direction of the plug end 15 with respect to the plug hole 31. Specifically, the two grooves 152 are symmetrically spaced on opposite sides of the plug end 15 and both connect to the side wall of the plug end 15 in a vertical direction along the insertion direction.

Referring to FIG. 2, the circuit housing 30 may be set in a flat shape, for example, the cross section of the circuit housing 30 at the second plug hole 31 may be oval, or other shapes capable of forming a flat shape. In this embodiment, two oppositely disposed side walls in the circuit housing 30 with a relatively large area may be the main side wall 33, and two oppositely disposed side walls, with a relatively small area, connecting the two main side walls 33 may be auxiliary side walls 34.

It should be noted that the above description of the MP3 player is only a specific example and should not be considered as the only feasible implementation solution. Obviously, for those skilled in the art, after understanding the basic principles of MP3 players, it is possible to make various modifications and alterations in the form and details of the specific methods and steps of implementing the working process of the MP3 player without departing from this principle, but these modifications and alterations are still within the scope described above. For example, the number of fixing sleeves 13 may not be limited to at least two as described in the embodiment, and the number may also be one, which may be specifically determined according to actual needs. As another example, the shape of the cross section at the plug hole 31 may not be limited to an oval shape, but may be other shapes, such as a triangle, a quadrangle, a pentagon, and other polygons. All such variations are within the protection scope of the present disclosure.

In some embodiments, the MP3 player may include an indicator light module (not shown in the figure) to display the status of the MP3 player. Specifically, the indicator light module may generate a light signal, and the status of the MP3 player may be obtained by observing the light signal. In some embodiments, an indicator light may show the battery status of the MP3 player. Merely by way of example, for example, when the indicator light is red, it may indicate that the power of the MP3 is insufficient (for example, the power of the MP3 player is less than 10%). As another example, when charging an MP3 player, the color of indicator light may be yellow, and when the MP3 player is fully charged, the color of indicator light may be green. In some alternative embodiments, for example, when the MP3 player is in a state of communicating with an external device, the indicator light may remain blinking, and may also display in other colors (such as blue). In some alternative embodiments, the indicator light may display the status of data transmission between the MP3 player and external devices. For example, when a user uses a mobile terminal to transmit data to an MP3 player, the indicator light may switch colors according to a specific frequency. As another example, the indicator light may show the fault state of the MP3 player. When the MP3 player is in the fault state, the indicator light may be red and remain blinking. In some embodiments, the indicator light module may also include an indicator light or a plurality of indicator light. In some embodiments, when there are a plurality of indicator lights, the color of the indicator lights may be the same or different.

It should be noted that the above description of the MP3 player is only a specific example and should not be considered as the only feasible implementation solution. Obviously, for those skilled in the art, after understanding the basic principles of MP3 players, it is possible to make various modifications and alterations in the form and details of the specific methods and steps of implementing the working process of the MP3 player without departing from this principle, but these modifications and alterations are still within the scope described above. For example, the number of indicator lights may not be limited to one, and a plurality of indicators may be selected according to specific needs. As another example, when the MP3 player is being charged, the indicator lights may display other colors (such as orange) or keep blinking. All such variations are within the protection scope of the present disclosure.

Under normal circumstances, the sound quality of MP3 players may be affected by a plurality of affecting factors such as the physical properties of the components of the loudspeaker, the vibration transmission relationship between the components, the vibration transmission relationship between the loudspeaker and the outside world, and the efficiency of the vibration transmission system when transmitting vibrations. The components of the loudspeaker may include components generating vibration (such as but not limited to an earphone core), components fixing loudspeaker (such as but not limited to ear hooks), and components transmitting vibration (such as but not limited to, a panel on an earphone core housing, a vibration transmission layer, etc.). The vibration transmission relationship between the various components and the vibration transmission relationship between the loudspeaker and the outside world may be determined by means of contacting between the loudspeaker and the user (such as but not limited to clamping force, contact area, contact shape, etc.).

Figure 10:
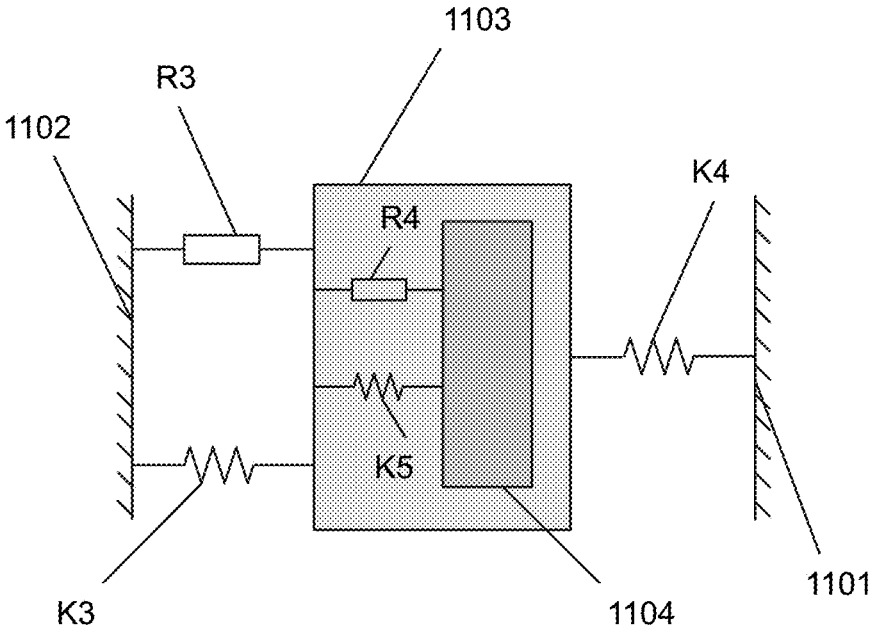
FIG. 10 is an equivalent model of the MP3 player vibration generation and transmission system according to some embodiments of the present disclosure.

Merely for illustration purposes, the relationship between the sound quality and the components of the loudspeaker may further be described below based on the bone conduction MP3 player. It should be understood that, without violating the principle, the content described below may also be applied to an air-conduction loudspeaker. FIG. 10 is an equivalent model of an MP3 player vibration generation and transmission system according to some embodiments of the present disclosure. As shown in FIG. 10, it may include a fixed end 1101, a sensing terminal 1102, a vibration unit 1103, and an earphone core 1104. The fixed end 1101 may be connected to the vibration unit 1103 through a transmission relationship K1 ($k_4$ in FIG. 10). The sensing terminal 1102 may be connected to the vibration unit 1103 through the transmission relationship K2 ($R_3$, $k_3$ in FIG. 10). The vibration unit 1103 may be connected to the earphone core 1104 through the transfer relationship K3 ($R_4$, $k_5$ in FIG. 10).

The vibration unit mentioned here may be an earphone core housing, and the transfer relationships K1, K2 and K3 may be descriptions of the functional relationships between the corresponding parts of the MP3 player equivalent system (may be described in detail below). The vibration equation of the equivalent system may be expressed as:

$$m_3x_3'+R_3x_3'-R_4x_4'+(k_3+k_4)x_3+k_5(x_3-x_4)=f_3 \quad (1)$$

$$m_4x_4''+R_4x_4''-k_5(x_3-x_4)=f_4 \quad (2)$$

wherein, $m_3$ may be the equivalent mass of the vibration unit 1103, $m_4$ may be the equivalent mass of earphone core 1104, $x_3$ may be the equivalent displacement of the vibration unit 1103, $x_4$ may be the equivalent displacement of earphone core 1104, $k_3$ may be the equivalent elastic coefficient between the sensing terminal 1102 and the vibration unit 1103, $k_4$ may be the equivalent elastic coefficient between the fixed end 1101 and the vibration unit 1103, $k_5$ may be the equivalent elastic coefficient between earphone core 1104 and vibration unit 1103, $R_3$ may be the equivalent damping between sensing terminal 1102 and vibration unit 1103, $R_4$ may be the equivalent damping between earphone core 1104 and vibration unit 1103, and $f_3$ and $f_4$ may be the interaction forces between the vibration unit 1103 and the earphone core 1104, respectively. The equivalent amplitude of the vibration unit in the system $A_3$ may be:

$$A_3 = -\frac{m_4\omega^2}{(m_3\omega^2 + j\omega R_3 - (k_3 + k_4 + k_5))(m_4\omega^2 + j\omega R_4 - k_5) - k_5(k_5 - j\omega R_4)} \cdot f_0 \quad (3)$$

wherein, $f_0$ may represent the unit driving force, and w may represent the vibration frequency. It can be seen that the factors that affect the frequency response of bone conduction MP3 players may include the generation of vibrations (such as but not limited to vibration unit, earphone core, housing, and interconnection methods, such as $m_3$, $m_4$, $k_5$, $R_4$, etc.) in the Equation (3), and vibration transmission part (such as but not limited to, the way of contact with the skin, the properties of the ear hooks, such as $k_3$, $k_4$, $R_3$, etc.) in the Equation (3). Changing the structure of each part of bone conduction MP3 player and the parameters of connection between various components, for example, changing the size of the clamping force may be equivalent to changing the size of $k_4$, changing the bonding method of the glue may be equivalent to changing the size of $R_4$ and $k_5$, changing the hardness, elasticity, damping, etc. of the relevant materials may be equivalent to changing the size of $k_3$ and $R_3$, may change the frequency response and sound quality of bone conduction MP3 players.

In a specific embodiment, the fixed end 1101 may be a relatively fixed point or a relatively fixed region of the bone conduction MP3 player during vibration, these points or regions may be regarded as the fixed end of the bone conduction MP3 player during vibration, the fixed end may be composed of specific components, and may also be a position determined according to the overall structure of the bone conduction MP3 player. For example, the bone conduction MP3 player may be hung on, bonded to or attached near human ears using a specific device, or the structure and shape of the bone conduction MP3 player may also be properly designed so that the position for bone conduction may cling to human skin.

The sensing terminal 1102 may be an audio system for the human body to receive sound signals. A vibration unit 1103 may be a part of the bone conduction MP3 player for protecting, supporting and connecting the earphone core, including parts that directly or indirectly contacting the user, such as a vibration transmission layer or a panel that transmits vibrations to the user, and a housing protecting and supporting other vibration-generating elements. The earphone core 1104 may be a sound vibration generating device, it may be a combination of one or more transducers discussed above.

The transmission relationship K1 may connect the fixed end 1101 and the vibration unit 1103, which indicates the vibration transmission relationship between the vibration generating part and the fixed end of the bone conduction MP3 player when the bone conduction MP3 player works. K1 may depend on the shape and structure of the bone conduction apparatus. For example, the bone conduction MP3 player may be fixed to the human head in a form of a U-shaped headphone holder/headphone strap, and may also be used in helmets, fire masks or other special-purposed masks, glasses, etc. Shapes and structures of different bone conduction MP3 players may affect the vibration transmission relationship K1. Furthermore, the structure of the loudspeaker may also include physical properties such as the composition material and quality of different parts of the bone conduction speaker. The transfer relationship K2 may connect the sensing terminal 402 and the vibration unit 1103.

K2 may depend on the composition of the transmission system, including but not limited to transmitting sound vibrations to the auditory system of a user through the user's tissue. For example, when sound is transmitted to the auditory system through the skin, subcutaneous tissue, bones, etc., the physical properties of different human tissues and their interconnections may affect K2. Further, the vibration unit 1103 may be in contact with human tissue. In different embodiments, the contact surface on the vibration unit may be a vibration transmission layer or a side of the panel, and the surface shape, the size of the contact surface, and the interaction force with the human tissue may affect the transfer coefficient K2.

The transmission relationship K3 between the vibration unit 1103 and the earphone core 1104 may be determined by the connection properties inside the apparatus generated by the vibrations of the bone conduction MP3 player. The earphone core and the vibration unit being connected in a rigid or elastic manner, or alterations of relative positions of connection devices between the earphone core and the vibration unit may change the transmission efficiency that the earphone core transmits vibrations to the vibration unit, especially to the panel, thereby affecting the transmission relationship K3.

During the usage of bone conduction MP3 players, the sound generation and transmission process may affect the sound quality finally sensed by the human body. For example, the fixed end, human sensory terminal, vibration unit, transducer, and transmission relations K1, K2, and K3, etc., as above-mentioned may all affect the sound quality of the bone conduction speaker. It should be noted that K1, K2, and K3 are just representations of the connection of different apparatus parts or systems involved in the vibration transmission process, including but not limited to physical connection methods, force transmission methods, and sound transmission efficiency, etc.

The above description of the bone conduction MP3 player equivalent system may just be a specific example and should not be considered as the only feasible implementation. Obviously, for those skilled in the art, after understanding the basic principles of bone conduction MP3 player, it is possible to make various modifications and alterations in the form and details of the specific methods and steps that affects the vibration transmission of bone conduction MP3 players without departing from this principle, but these modifications and alterations are still within the scope described above. For example, K1, K2, and K3 described above may be simple vibration or a mechanical transmission manner, and may also include a complex non-linear transmission system. The transmission relationship may be formed by direct connections of various parts, or transmitted in non-contact manner.

Figure 11:
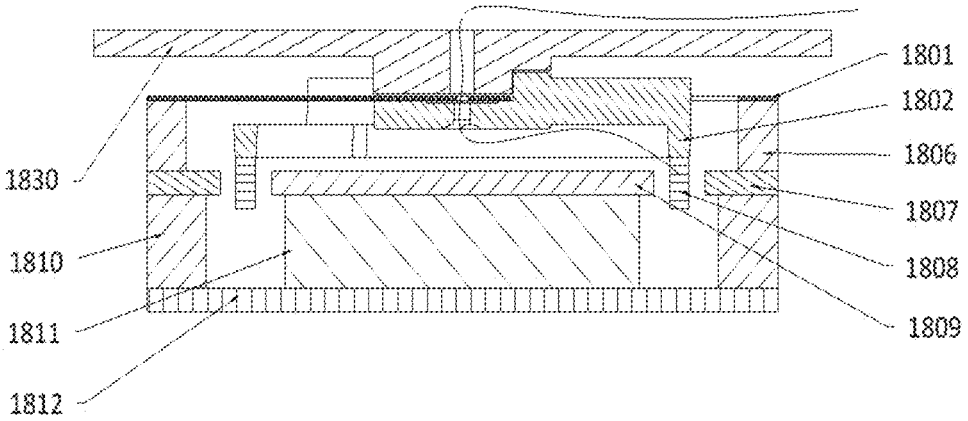
FIG. 11 is a structural diagram illustrating a composite vibration apparatus of an MP3 player according to some embodiments of the present disclosure.
Figure 12:
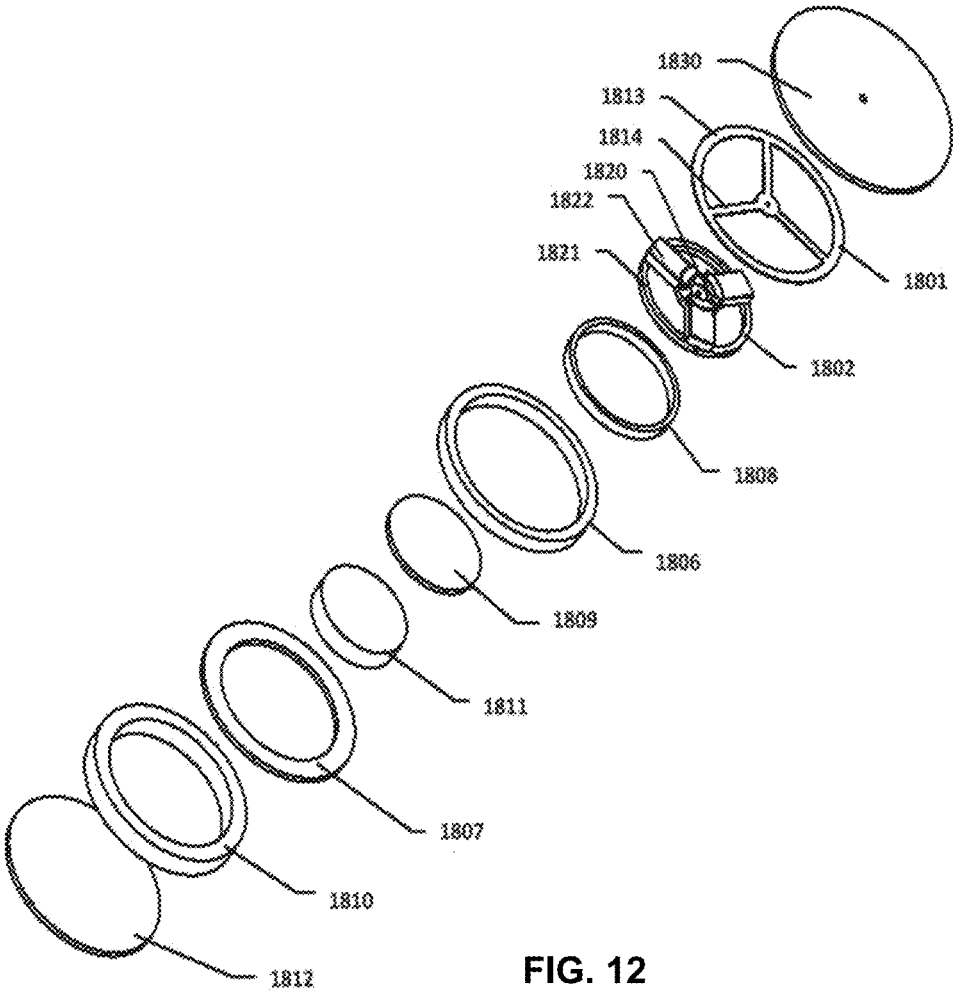
FIG. 12 is a structural diagram illustrating a composite vibration apparatus of an MP3 player according to some embodiments of the present disclosure.

FIG. 11 is a structural diagram illustrating a composite vibration apparatus of an MP3 player according to some embodiments of the present disclosure; FIG. 12 is a structural diagram illustrating a composite vibration apparatus of an MP3 player according to some embodiments of the present disclosure embodiment.

In some embodiments, the MP3 player may further be provided with a composite vibration apparatus. In some embodiments, the composite vibration apparatus may be part of the earphone core. In some embodiments, the composite vibration apparatus in FIG. 11 may be a vibration part inside the earphone core housings 20 in FIG. 2 that provides sound. Specifically, the composite vibration apparatus in the embodiment of the present disclosure may be equivalent to a specific embodiment of the transmission relationship K3 of the vibration unit 1103 and the earphone core 1104 in FIG. 10. An embodiment of a composite vibration apparatus on an MP3 player may be shown in FIG. 11 and FIG. 12, and a vibration conducting sheet 1801 and a vibration board 1802 may constitute a composite vibration apparatus. The vibration conducting sheet 1801 may be set as a first ring body 1813, and three first supporting rods 1814 which converge toward the center of the first ring body may be set in the first ring body. The position of the convergence center may be the center of the vibration board 1802. The center of the vibration board 1802 may be a groove 1820 matching the convergence center and the first support rods. The vibration board 1802 may be provided with the second ring body 1821 with a radius different from that of the vibration conducting sheet 1801, and three second supporting rods 1822 with different thicknesses from the first supporting rods 1814. During assembly, the first supporting rods 1814 and the second supporting rods 1822 may be disposed in a staggered manner, but may not limited to a 60-degrees angle.

Figure 13:
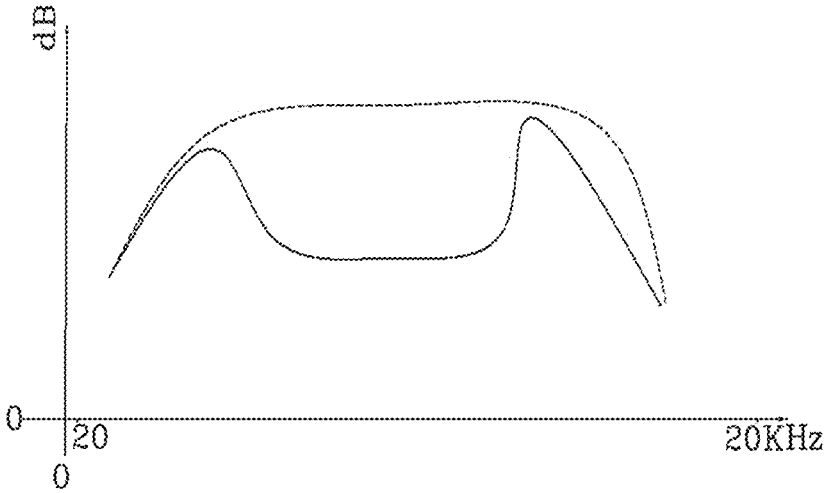
FIG. 13 is a frequency response curve of an MP3 player according to some embodiments of the present disclosure.

Both the first supporting rods and the second supporting rods may be straight supporting rods or set in other shapes that meet specific requirements, the number of the supporting rods may be set to more than two, and symmetrical or asymmetrical arrangement may be adopted so as to meet the requirements of economic and practical effects. The vibration conducting sheet 1801 may have a thin thickness to increase elasticity. The vibration conducting sheet 1801 may be stuck in the center of the groove 1820 of the vibration board 1802. A voice coil 1808 may be attached to the lower side of the second ring body 1821 of the vibration board 1802. The composite vibration apparatus may further include a bottom plate 1812 on which an annular magnet 1810 may be disposed, and an inner magnet 1811 may be concentrically disposed on the annular magnet 1810. An inner magnetic plate 1809 may be set on the top surface of the inner magnet 1811, and an annular magnetic plate 1807 may be set on the ring magnet 1810. A washer 1806 may be fixedly disposed above the annular magnetic plate 1807, and the first ring body 1813 of the vibration conducting sheet 1801 may be fixedly connected to the washer 1806. The entire composite vibration apparatus may be connected to the outside through a panel 1830. The panel 1830 may be fixedly connected to the center of the convergence of the vibration conducting sheet 1801, and fixed to the center of the vibration conducting sheet 1801 and the vibration board 1802. Using the composite vibration apparatus including the vibration board and vibration conducting sheet, the frequency response of the composite vibration apparatus as shown in FIG. 13 may be obtained, and two resonance peaks may be generated. By adjusting parameters such as the size and material of the two components, the resonance peak may appear at different positions. For example, a low-frequency resonance peak may appear at a lower frequency position, and/or a high-frequency resonance peaks may appear at a higher frequency position. Preferably, the stiffness coefficient of the vibration board may be greater than that of the vibration conducting sheet, such that the vibration board may generate a high-frequency resonance peak in the two resonance peaks, and the vibration conducting sheet may generate a low-frequency resonance peak in the two resonance peaks. The frequency range of these resonance peaks may be set within the frequency range of the sound audible to the human ear, and may be set outside the frequency range of the sound audible to the human ear, preferably, the two resonance peaks may be outside the frequency of the sound; more preferably, one frequency range of a resonance peak may be within the frequency range of the sound audible to the human ear, and the other resonance peak may be out of the frequency range of the sound audible to the human ear; more preferably, both resonance peaks may be within the frequency range of the sound audible to the human ear; and still further preferably, both resonance peaks may be within a frequency range of the sound audible to the human ear, and the peak frequencies may be between 80 Hz to 18000 Hz; still further preferably, both resonance peaks may be within the frequency range of the sound audible to the human ear, and the peak values may be between 200 Hz to 15000 Hz; still further preferably, both resonance peaks may be within a frequency range of the sound audible to the human ear, and the peak values may be between 500 Hz and 12000 Hz; still further preferably, both resonance peaks may be within a frequency range of the sound audible to the human ear, and the peak values may be between 800 Hz to 11000 Hz. The frequency of the peaks of the resonance peaks should preferably have a certain difference, for example, the peak frequency of the two resonance peaks may differ by at least 500 Hz; preferably, the peak frequency of the two resonance peaks may differ by at least 1000 Hz; still further preferably, the peak frequency of the two resonance peaks may differ by at least 2000 Hz; still more preferably, the peak frequency of the two resonance peaks may differ by at least 5000 Hz. In order to achieve a better effect, the two resonance peaks may be within the audible range of the human ear, and the peak frequency of the resonance peaks may differ by at least 500 Hz different; preferably, the two resonance peaks may be both within the audible range of the human ear, and the peak frequency of the two resonance peaks may differ by at least 1000 Hz; still further preferably, the two resonance peaks may both be within the audible range of the human ear, and the peak frequency of the two resonance peaks may differ by at least 2000 Hz; and even more preferably, the two resonance peaks may be both within the audible range of the human ear, and the peak frequency of the two resonance peaks may differ by at least 3000 Hz; it may also be further preferred that the two resonance peaks may be both within the audible range of the human ear, and the peak frequency of the two resonance peaks may differ by at least 4000 Hz. The frequency range of one of the two resonance peaks may be within the frequency range of the sound audible to the human ear and the frequency range of the other resonance peak may be outside the audible range of the human ear, and the peak frequency of the two resonance peaks may be at least 500 Hz different; preferably, the frequency range of one resonance peak may be within the audible range of the human ear and the other resonance peak may be outside the audible range of the human ear, and the peak frequencies of the two resonance peaks may differ by at least 1000 Hz; more preferably, the frequency range of one resonance peak may be within the audible range of the human ear and the other resonance peak may be outside the audible range of the human ear, and the peak frequencies of the two resonance peaks may differ by at least 2000 Hz; further preferably, the frequency range of one resonance peak may be within the audible range of the human ear and the other resonance peak may be outside the audible range of the human ear, and the peak frequencies of the two resonance peaks may differ by at least 3000 Hz; still further preferably, the frequency range of one resonance peak may be within the audible range of the human ear and the other resonance peak may be outside the audible range of the human ear, and the peak frequencies of the two resonance peaks may differ by at least 4000 Hz. The peak frequencies of both resonance peaks may be between 5 Hz-30000 Hz, and the peak frequencies of the two resonance peaks may differ by at least 400 Hz; preferably, the peak frequencies of the two resonance peaks may be both between 5 Hz and 30000 Hz, and the peak frequencies of the two resonance peaks may differ by at least 1000 Hz; more preferably, the peak frequencies of the two resonance peaks may be both between 5 Hz and 30000 Hz, and the peak frequencies of the two resonance peaks may differ by at least 2000 Hz; further preferably, the peak frequencies of the two resonance peaks may be both in a frequency between 5 Hz and 30000 Hz, and the peak frequencies of the two resonance peaks may differ by at least 3000 Hz; still further preferably, the peak frequencies of the two resonance peaks may be both between 5 Hz and 30000 Hz, and the peak frequencies of the two resonance peaks may differ by at least 4000 Hz. The peak frequencies of the two resonance peaks may be between 20 Hz-20000 Hz, and the peak frequencies of the two resonance peaks may be at least 400 Hz different; preferably, the frequencies of the two resonance peaks may be both between 20 Hz-20000 Hz, and the peak frequencies of the two resonance peaks may differ by at least 1000 Hz; more preferably, the two resonance peaks may be both between 20 Hz and 20,000 Hz, and the peak frequencies of the two resonance peaks may differ at least 2000 Hz; further preferably, the frequencies of the two resonance peaks may be both between 20 Hz and 20,000 Hz, and the peak frequencies of the two resonance peaks may differ at least 3000 Hz; still further preferably, the frequencies of the two resonance peaks may be both between 20 Hz and 20,000 Hz, and the peak frequencies of the two resonance peaks may differ by at least 4000 Hz. The two resonance peaks may be between 100 Hz-18000 Hz, and the peak frequencies of the two resonance peaks may differ at least 400 Hz; preferably, the peak frequencies of the two resonance peaks may be both between 100 Hz and 18000 Hz, and the peak frequencies of the two resonance peaks may differ at least 1000 Hz; more preferably, the peak frequencies of the two resonance peaks may be both between 100 Hz and 18000 Hz, and the peak frequencies of the two resonance peaks may differ by at least 2000 Hz; further preferably, the two resonance peaks may be both between a frequency of 100 Hz to 18000 Hz, and the peak frequencies of the two resonance peaks may differ by at least 3000 Hz; still further preferably, the peak frequencies of the two resonance peaks may be both between 100 Hz and 18000 Hz, and the peak frequencies of the two resonance peaks may differ by at least 4000 Hz. The peak frequencies of both resonance peaks may be between 200 Hz-12000 Hz, and the peak frequencies of the two resonance peaks may differ at least 400 Hz; preferably, the frequencies of the two resonance peaks may be both between 200 Hz and 12000 Hz, and the peak frequencies of the two resonance peaks may differ at least 1000 Hz; more preferably, the peak frequencies of the two resonance peaks may be both between 200 Hz and 12000 Hz, and the peak frequencies of the two resonance peaks may differ by at least 2000 Hz; further preferably, the peak frequencies of two resonance peaks may be both between 200 Hz and 12000 Hz, and the peak frequencies of the two resonance peaks may differ at least 3000 Hz; still further preferably, the frequencies of the two resonance peaks may be both between 200 Hz and 12000 Hz, and the peak frequencies of the two resonance peaks may differ by at least 4000 Hz. The frequency range of the two resonance peaks may be between 500 Hz-10000 Hz, and the peak frequencies of the two resonance peaks may differ at least 400 Hz; preferably, the peak frequencies of the two resonance peaks may be both between 500 Hz and 10000 Hz, and the peak frequencies of the two resonance peaks may differ at least 1000 Hz; more preferably, the peak frequencies of the two resonance peaks may be both between 500 Hz and 10000 Hz, and the peak frequencies of the two resonance peaks may differ by at least 2000 Hz; further preferably, the frequency range of the two resonance peaks may be both between 500 Hz and 10000 Hz, and the peak frequencies of the two resonance peaks may differ by at least 3000 Hz; still further preferably, the peak frequencies of the two resonance peaks may be both between 500 Hz and 10000 Hz, and the peak frequencies of the two resonance peaks may differ by at least 4000 Hz. In this way, the resonance response range of the loudspeaker may be widened, and the sound quality satisfying the conditions may be obtained. It is worth noting that during actual use, a plurality of vibration conducting sheets and vibration boards may be set to form a multilayer vibration structure corresponding to different frequency response ranges, respectively, achieving high-quality loudspeaker vibration with full range and full frequency response, or making the frequency response curve meet the requirements for using in some specific frequency ranges. For example, in order to meet normal auditory requirements, an earphone core consisting of one or more vibration boards and vibration conducting sheets with a resonance frequency in the range of 100 Hz-10000 Hz may be selected in a bone conduction hearing-aid. The description of the composite vibration apparatus composed of a vibration board and a vibration conducting sheet in the Chinese patent application No. 201110438083.9, filed on Dec. 23, 2011, named "A bone conduction speaker and composite vibration apparatus thereof", which is incorporated herein by reference in its entirety.

Figure 14:
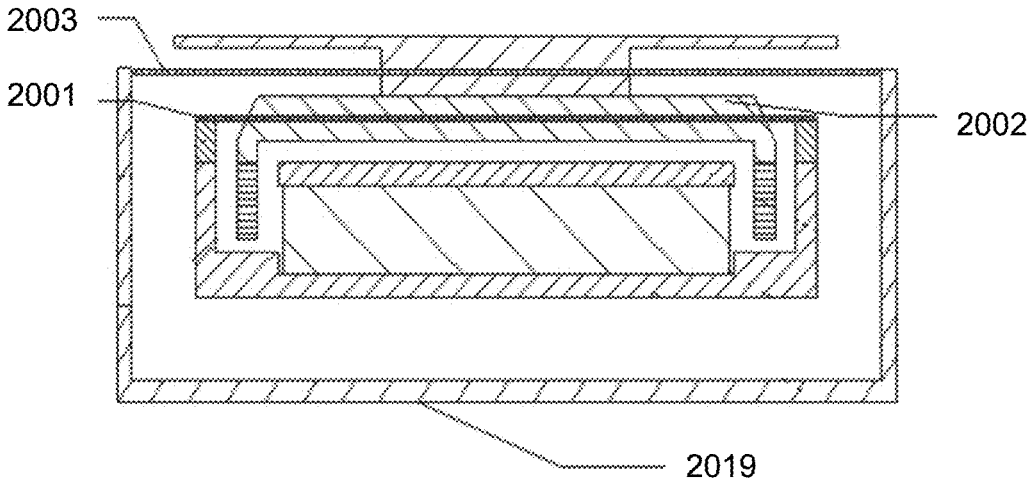
FIG. 14 is a structural diagram illustrating an MP3 player and a composite vibration apparatus thereof according to some embodiments of the present disclosure.

FIG. 14 is a structural diagram illustrating a composite vibration apparatus of an MP3 player according to some embodiments of the present disclosure. As shown in FIG. 14, in some embodiments, the composite vibration apparatus may include a vibration board 2002, a first vibration conducting sheet 2003, and a second vibration conducting sheet

2001. The first vibration conducting sheet 2003 may fix the vibration board 2002 and the second vibration conducting sheet 2001 on the housing 2019. The composite vibration apparatus including the vibration board 2002, the first vibration conducting sheet 2003 and the second vibration conducting sheet 2001 may generate no less than two resonance peaks, and a flatter frequency response curve within the audible range of the hearing system, thereby improving the sound quality of the loudspeaker.

Figure 15:
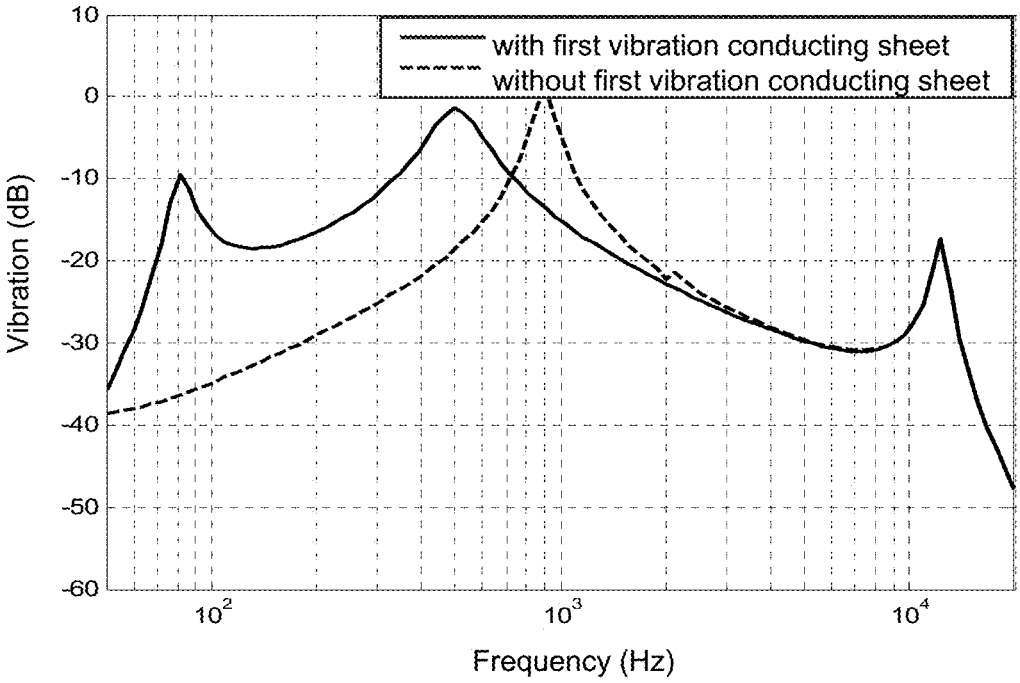
FIG. 15 is a vibration response curve of an MP3 player according to some embodiments of the present disclosure.

The number of resonance peaks generated in the triple composite vibration system including the first vibration conducting sheet may be greater than that of the composite vibration system without the first vibration conducting sheet. Preferably, the triple composite vibration system may generate at least three resonance peaks; more preferably, the peak frequency of at least one resonance peak may not be within a range audible to the human ear; more preferably, the peak frequencies of the resonance peaks may all be within a range audible to the human ear; still further preferably, the peak frequencies of the resonance peaks may all be within a range audible to the human ear, and may not be higher than 18000 Hz; still further preferably, the peak frequencies of the resonance peaks may be all within a frequency range of sounds audible to the human ear, and may be between 100 Hz and 15000 Hz; still further preferably, the peak frequencies of the resonance peaks may all be within a frequency range of the sound audile to the human ear, and may be between 200 Hz and 12000 Hz; still further preferably, the resonance peaks may all be within a frequency range of the sound audible to the human ear, and may be between 500 Hz and 11000 Hz. The peak frequencies of the peaks of the resonance peaks may preferably have a certain gap, for example, the peak frequencies of at least two resonance peaks may differ by at least 200 Hz; preferably, the peak frequencies of at least two resonance peaks may differ by at least 500 Hz; more preferably, the peak frequencies of at least two resonance peaks may differ by at least 1000 Hz; still further preferably, the peak frequencies of the at least two resonance peaks may differ by at least 2000 Hz; still further preferably, the peak frequencies of at least two resonance peaks may differ by at least 5000 Hz. In order to achieve a better effect, the resonance peaks may all be within the audible range of the human ear, and the peak frequencies of at least two resonance peaks may differ by at least 500 Hz; preferably, the resonance peaks may all be within the audible range of the human ear, and the peak frequencies of at least two resonance peaks may differ by at least 1000 Hz; more preferably, the resonance peaks may be within the audible range of the human ear, and the peak frequencies of at least two resonance peaks may differ by at least 1000 Hz; still further preferably, the resonance peaks may all be within the audible range of the human ear, and the peak frequencies of at least two resonance peaks may differ by at least 2000 Hz; and even more preferably, the resonance peaks may all be within the audible range of the human ear, and the peak frequencies of at least two resonance peaks may differ by at least 3000 Hz; still more preferably, the resonance peaks may be within the audible range of the human ear, and the peak frequencies of at least two resonance peaks may differ by at least 4000 Hz. Two of the resonance peaks may be within the audible range of the human ear, and the other may be out of the audible range of the human ear, and the peak frequencies of at least two resonance peaks may differ by at least 500 Hz; preferably, the two resonance peaks may be within the audible range of the human ear, the other resonance peak may be outside the audible range of the human ear, and the peak frequency of at least two resonance peaks may differ by at least 1000 Hz; more preferably, the two resonance peaks may be within the audible range of the human ear and the other resonance peak may be out of the audible range of the human ear, and the peak frequencies of at least two resonance peaks may differ by at least 2000 Hz; further preferably, the two resonance peaks may be within the audible range of the human ear and the other resonance peak may be out of the audible range of the human ear, and the peak frequencies of at least two resonance peaks may differ by at least 3000 Hz; still further preferably, the two resonance peaks may be within the audible range of the human ear and the other resonance peak may be out of the audible range of the human ear, and the peak frequencies of at least two resonance peaks may differ by at least 4000 Hz. One of the resonance peaks may be within the audible range of the human ear, the other two resonance peaks may be out of the audible range of the human ear, and the peak frequencies of at least two resonance peaks may differ by at least 500 Hz; preferably, one resonance peak may be within the audible range of the human ear, the other two resonance peaks may be out of the audible range of the human ear, and the peak frequencies of at least two resonance peaks may differ by at least 1000 Hz; more preferably, one resonance peak may be within the audible range of the human ear, the other two resonance peaks may be out of the audible range of the human ear, and the peak frequencies of at least two resonance peaks may differ by at least 2000 Hz; further preferably, one resonance peak may be within the audible range of the human ear, the other two resonance peaks may be out of the audible range of the human ear, and the peak frequencies of at least two resonance peaks may differ by at least 3000 Hz; still further preferably, one resonance peak may be within the audible range of the human ear, the other two resonance peaks are outs of the audible range of the human ear, and the peak frequencies of at least two resonance peaks may differ by at least 4000 Hz. The resonance peaks may all be between 5 Hz to 30000 Hz, and the peak frequencies of at least two resonance peaks may differ by at least 400 Hz; preferably, the resonance peaks may all be between 5 Hz to 30000 Hz, and the peak frequencies of at least two resonance peaks may differ by at least 1000 Hz; more preferably, the resonance peaks may all be between 5 Hz to 30000 Hz, and the peak frequencies of at least two resonance peaks may differ by at least 2000 Hz; further preferably, the resonance peaks may all be between 5 Hz to 30000 Hz, and the peak frequencies of at least two resonance peaks may differ by at least 3000 Hz; even more preferably, the resonance peaks may all be between 5 Hz to 30000 Hz, and the peak frequencies of at least two resonance peaks may differ by at least 4000 Hz. The resonance peaks may all be between 20 Hz to 20000 Hz, and the peak frequencies of at least two resonance peaks may differ by at least 400 Hz; preferably, the resonance peaks may all be between 20 Hz to 20,000 Hz, and the peak frequencies of at least two resonance peaks may differ by at least 1000 Hz; more preferably, the resonance peaks may all be between 20 Hz to 20,000 Hz, and the peak frequencies of at least two resonance peaks may differ by at least 2000 Hz; further preferably, the resonance peaks may all be between 20 Hz to 20,000 Hz, and the peak frequencies of at least two resonance peaks may be different by at least 3000 Hz; still further preferably, the resonance peaks may all be between 20 Hz to 20000 Hz, and the peak frequency of at least two resonance peaks may differ by at least 4000 Hz. The frequencies of the resonance peaks may all be between 100 Hz to 18000 Hz, and the peak frequencies of at least two resonance peaks may differ by at least 400 Hz; preferably, the resonance peaks may all be between 100 Hz to 18000 Hz, and the peak frequencies of at least two resonance peaks may differ at least 1000 Hz different; more preferably, the frequencies of the resonance peaks may all be between 100 Hz to 18000 Hz, and the peak frequencies of at least two resonance peaks may differ by at least 2000 Hz; further preferably, the frequencies of the resonance peaks may all be between a frequency of 100 Hz to 18000 Hz, and the peak frequencies of at least two resonance peaks may differ by at least 3000 Hz; still further preferably, the resonance peaks may all be between 100 Hz to 18000 Hz, and the peak frequencies of at least two resonance peaks may differ by at least 4000 Hz. The frequencies of the resonance peaks may all be between 200 Hz to 12000 Hz, and the peak frequencies of at least two resonance peaks may differ by at least 400 Hz; preferably, the resonance peaks may all be between 200 Hz to 12000 Hz, and the peak frequencies of at least two resonance peaks may differ at least 1000 Hz; more preferably, the resonance peaks may all be between 200 Hz to 12,000 Hz, and the peak frequencies of at least two resonance peaks may differ by at least 2000 Hz; further preferably, the frequencies of the resonance peaks may all be between 200 Hz to 12000 Hz, and the peak frequencies of at least two resonance peaks may differ at least 3000 Hz; still further preferably, the resonance peaks may all be between 200 Hz to 12,000 Hz, and the peak frequencies of at least two resonance peaks may differ by at least 4000 Hz. The frequencies of the resonance peaks may all be between 500 Hz to 10000 Hz, and the peak frequencies of at least two resonance peaks may differ by at least 400 Hz; preferably, the resonance peaks may all be between 500 Hz to 10000 Hz, and the peak frequencies of at least two resonance peaks may differ by at least 1000 Hz; more preferably, the resonance peaks may all be between 500 Hz to 10,000 Hz, and the peak frequencies of at least two resonance peaks may differ by at least 2000 Hz; further preferably, the resonance peaks may all be between 500 Hz to 10000 Hz, and the peak frequencies of at least two resonance peaks may differ by at least 3000 Hz; still further preferably, the resonance peaks may all be between 500 Hz to 10000 Hz, and the peak frequencies of at least two resonance peaks may differ by at least 4000 Hz. In one embodiment, by using a triple composite vibration system composed of a vibration board, a first vibration conducting sheet, and a second vibration conducting sheet, the frequency response as shown in FIG. 15 may be obtained, and three obvious resonance peaks may be generated, which may greatly improve the sensitivity of the loudspeaker frequency response in the low frequency range (about 600 Hz) and improve the sound quality.

By changing parameters such as the size and material of the first vibration conducting sheet, the resonance peak may be shifted to obtain a more ideal frequency response. Preferably, the first vibration conducting sheet may be an elastic sheet. The elasticity may be determined by various factors such as the material, thickness, and structure of the first vibration conducting sheet. The material of the first vibration conducting sheet, such as but not limited to, steel (such as but not limited to stainless steel, carbon steel, etc.), lightweight alloys (such as but not limited to, aluminum alloys, beryllium copper, magnesium alloys, titanium alloys, etc.), plastics (such as but not limited to, high-molecular polyethylene, blown nylon, engineering plastics, etc.) or other single or composite materials that may achieve the same performance. Composite materials may include, such as but not limited to glass fiber, carbon fiber, boron fiber, graphite fiber, graphene fiber, silicon carbide fiber, or aramid fiber, and other reinforcing materials, or a composite of other organic and/or inorganic materials, such as glass fiber reinforced unsaturated polyester, epoxy resin or phenolic resin composed of various types of glass steel. The thickness of the first vibration conducting sheet may not be less than 0.005 mm, preferably, the thickness may be 0.005 mm-3 mm, more preferably, the thickness may be 0.01 mm-2 mm, even more preferably, the thickness may be 0.01 mm-1 mm, and even more preferably, the thickness may be 0.02 mm-0.5 mm. The structure of the first vibration conducting sheet may be set in a ring shape, and preferably, the first vibration conducting sheet may include at least one ring, preferably, the first vibration conducting sheet may include at least two rings, which may be concentric rings or non-concentric rings, the rings may be connected by at least two supporting rods, and the supporting rods may converge from the outer ring to the center of the inner ring. Further preferably, at least one elliptical ring may be included, and further preferably, at least two elliptical rings may be included, different elliptical rings may have different radius of curvature, and the rings may be connected by a supporting rod, still further preferably, the first vibration conducting sheet may include at least one square ring. The first vibration conducting sheet structure may also be set as a sheet shape, preferably, a hollow pattern may be provided on the top of the first vibration conducting sheet, and the area of the hollow pattern may not be less than the area without the hollow. In the above description, the materials, thickness, and structures may be combined into different vibration conducting sheets. For example, the annular vibration conducting sheet may have different thickness distributions, preferably, the thickness of the supporting rods may be equal to that of the ring, further preferably, the thickness of the supporting rods may be greater than that of the ring, and even more preferably, the thickness of the inner ring may be greater than that of the outer ring.

Figure 16:
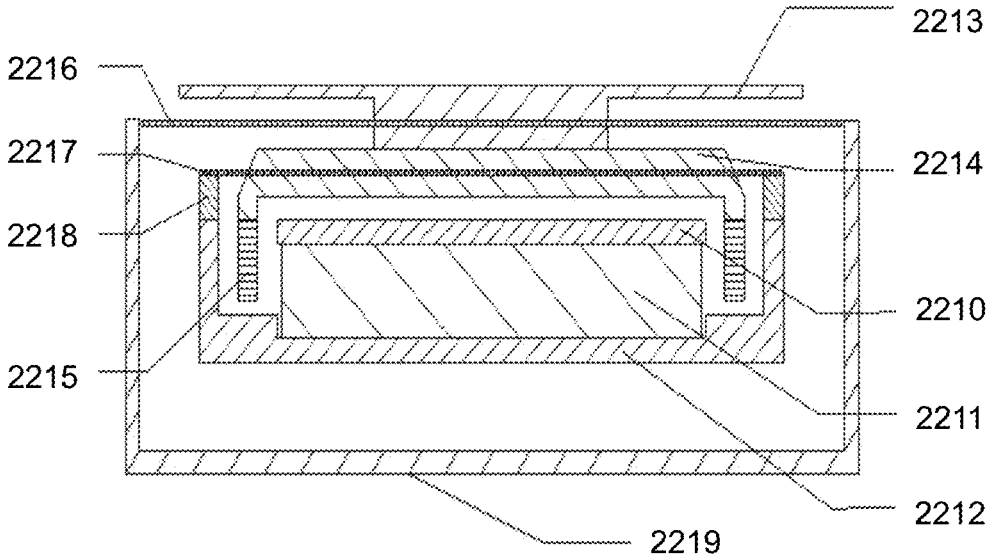
FIG. 16 is a structural diagram illustrating a vibration generating portion of an MP3 player according to some embodiments of the present disclosure.

The present disclosure also discloses specific embodiments regarding a vibration board, a first vibration conducting sheet, and a second vibration conducting sheet for the content described above. FIG. 16 is a structural diagram illustrating a vibration generating portion of an MP3 player according to some embodiments of the present disclosure. As shown in FIG. 16, the earphone core may include a magnetic circuit system including a magnetic conductive plate 2210, a magnet 2211, and a magnetic conductive plate 2212, a vibration board 2214, coils 2215, a first vibration conducting sheet 2216, and a second vibration conducting sheet 2217. The panel 2213 (that is, the side of the earphone core housing that is close to the user) may protrude the housing 2219, and may bond the vibration piece 2214 by glues. The first vibration conducting sheet 2216 may fix the earphone core to the housing 2219 to form a suspension structure.

Figure 17:
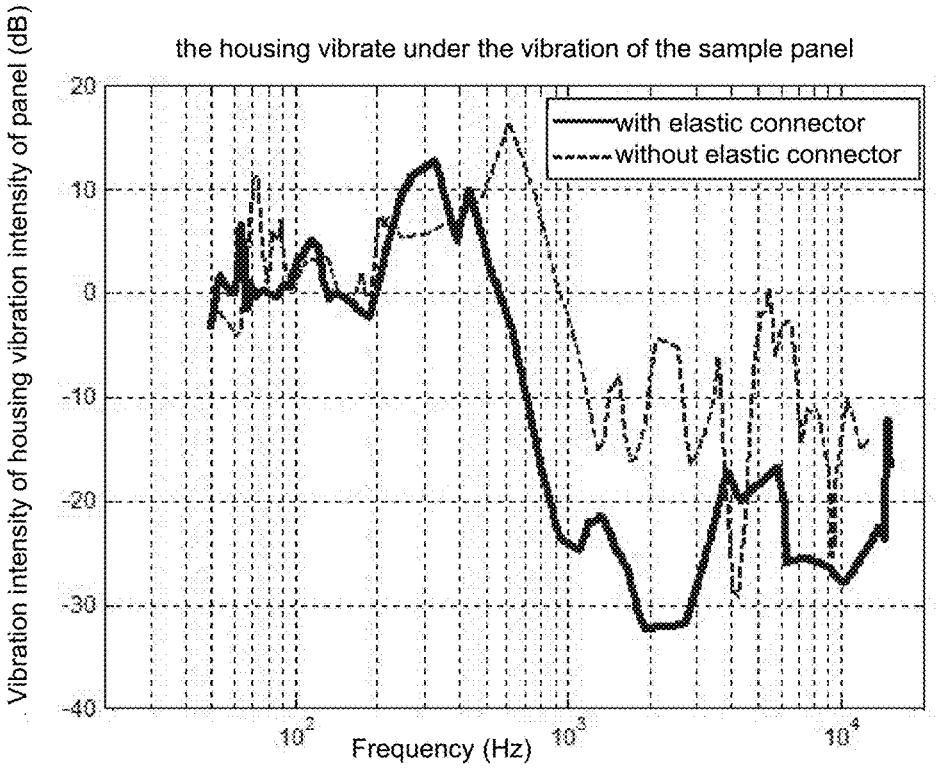
FIG. 17 is a vibration response curve of a vibration generating portion of an MP3 player according to some embodiments of the present disclosure.
Figure 18:
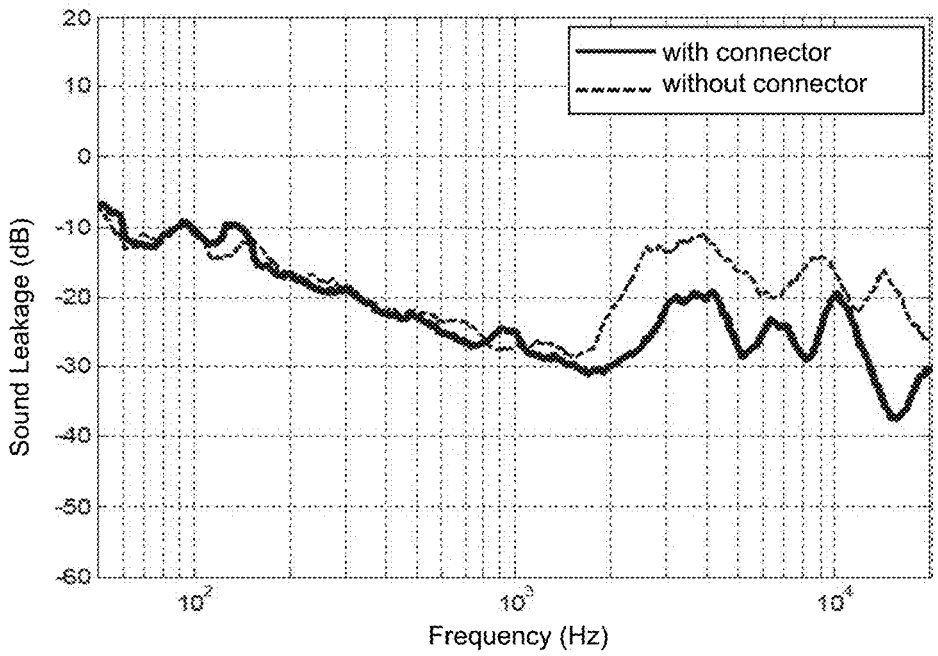
FIG. 18 is a vibration response curve of a vibration generating portion of an MP3 player according to some embodiments of the present disclosure.

During the operation of the bone conduction MP3 player, the triple vibration system composed of the vibration board 2214, the first vibration conducting sheet 2216, and the second vibration conducting sheet 2217 may generate a more flatter frequency response curve, thereby improving the sound quality of the bone conduction MP3 player. The first vibration conducting sheet 2216 may elastically connect the earphone core to the housing 2219, which may reduce the vibration transmitted by the earphone core to the housing, thereby effectively reducing the sound leakage caused by the vibration of the housing, and also reducing the influence of the vibration of the housing on the sound quality of the bone conduction MP3 player. FIG. 17 shows a response curve of the vibration intensity of the housing and the vibration intensity of the panel with frequency. The thick line may show the frequency response of the vibration generating part using the first vibration conducting sheet 2216, and the thin line shows the frequency response of the vibration generating part without using the first vibration conducting sheet 2216. It may be seen that, in the frequency range above 500 Hz, the vibration of the bone conduction MP3 player housing without the first vibration conducting sheet 2216 may be significantly greater than that of the bone conduction MP3 player housing with the first vibration conducting sheet 2216. FIG. 18 shows a comparison of the sound leakage in the case where the first vibration conducting sheet 2216 is included and the sound leakage in the case where the first vibration conducting sheet 2216 is not included. The sound leakage of the apparatus containing the first vibration conducting sheet 2216 in the intermediate frequency (for example, about 1000 Hz) may be less than that of the apparatus without the first vibration conducting sheet 2216 in the corresponding frequency range. It may be seen from this that by using the first vibration conducting sheet between the panel and the housing, the vibration of the housing may be effectively reduced, thereby reducing the sound leakage. In some embodiments, the first vibration conducting sheet may include but not limited to stainless steel, beryllium copper, plastic, and polycarbonate materials, and the thickness of the first vibration conducting sheet may be in the range of 0.01 mm-1 mm.

It should be noted that the above description of the bone conduction MP3 player is only a specific example and should not be considered as the only feasible implementation. Obviously, for those skilled in the art, after understanding the basic principles of bone conduction MP3 player, it is possible to make various modifications and alterations in the form and details of the specific methods and steps for implementing the working process of the bone conduction MP3 player without departing from this principle, but these modifications and alterations are still within the scope described above. For example, the first vibration conducting sheet may not be limited to including one or two rings described above, and the number may be two or more. As another example, the shapes of a plurality of elements of the first vibration conducting sheet may be the same or may be different (there are a ring and a square ring in the element). All such variations may be within the protection scope of the present disclosure.

Referring to FIG. 10 again, the transmission relationship K2 between the sensing terminal 1102 and the vibration unit 1103 may also affect the frequency response of the bone conduction MP3 player. The sound heard by the human ear may depend on the energy received by the cochlea, the energy may be affected by different physical quantities during the transmission process and may be expressed by the following equation:

$$P=\iint_S \alpha \cdot f(a,R) \cdot L \cdot ds \quad (4)$$

wherein, P is proportional to the energy received by the cochlea, S is the area where the contact surface contacts the human face, and a is a dimensional conversion coefficient. f (a, R) represents the acceleration of a point on the contact surface and the closeness of the contact surface to the skin, R, on the energy transfer. L is the impedance of mechanical wave transmission at any contact point, that is, the transmission impedance per unit area.

It may be known from (4) that the transmission of the sound may be affected by the transmission impedance L, the vibration transmission efficiency of the bone conduction MP3 player may be related to L, the frequency response curve of the bone conduction MP3 player may be the superposition of the frequency response curves of each point on the contact surface. Factors that affect the impedance may include the size, shape, roughness, force distribution, force distribution of the energy transfer area, etc. For example, by changing the structure and shape of the vibration unit to change the sound transmission effect, and change the sound quality of the bone conduction MP3 player. Merely by way of example, changing the corresponding physical characteristics of the contact surface of the vibration unit may achieve the effect of changing the sound transmission.

Figure 19:
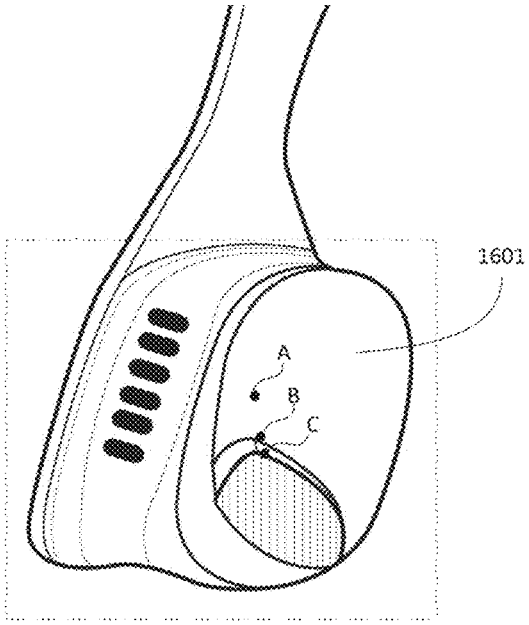
FIG. 19 is a schematic diagram illustrating a vibrating unit contact surface of an MP3 player according to some embodiments of the present disclosure.

FIG. 19 is a schematic diagram illustrating a vibration unit contact surface of an MP3 player according to the embodiment of the present disclosure. In some embodiments, the contact surface of the vibration unit in FIG. 19 may be equivalent to the outer wall in contact with the human body at the earphone core housings 20 in FIG. 2. The embodiment may be a specific embodiment of the transmission relationship K2 between the sensing terminal 1102 and the vibration unit 1103. As shown in FIG. 19, a well-designed surface of a contact surface may be provided with a gradient structure, and the gradient structure may refer to a region where the surface of the contact surface has a height variation. The gradient structure may be a convex/concave or stepped structure on the outside of the contact surface (the side that is in contact with the user), or may also be a convex/concave or stepped structure on the inside of the contact surface (the side facing away from the user). It should be known that the contact surface of the vibration unit may fit on any position of the user's head, for example, the top of the head, forehead, cheeks, hips, auricles, back of auricles, or the like. As shown in FIG. 19, the contact surface 1601 (outer side of the contact surface) may have convexities or concaves (not shown in FIG. 19). During the operation of the bone conduction MP3 player, the convex or concave portion may be in contact with the user, which changes the pressures at different positions where the contact surface 1601 contact the human face. The convex part may be in closer contact with the human face, and the skin and subcutaneous tissue that comes into contact with it may be more stressed than other parts; correspondingly, the skin and subcutaneous tissue that are in contact with the concave part may be subjected to less pressure than other parts. For example, there are three points A, B, and C on the contact surface 1601 in FIG. 19, which are located on the non-convex portion, on the edge of the convex portion, and on the convex portion of the contact surface 1601, respectively. In contacting with the skin, the clamping force on the skin at three points A, B, and C may be FC>FA>FB. In some embodiments, the clamping force of point B may be 0, that is, point B may not be in contact with the skin. Human skin and subcutaneous tissue may show different impedance and response to the sound under different pressures. The impedance ratio may be small in the part with high pressure, which has a high-pass filtering characteristic for sound waves, and the impedance ratio may be large in the part with a low pressure, which has a low-pass filtering characteristic. The impedance characteristic L of each part of the contact surface 1601 may be different. According to Equation (4), different parts may respond differently to the frequency of sound transmission, the effect of sound transmission through the full contact surface may be equivalent to the sum of sound transmission in each part. When the sound is finally transmitted to the brain, a smooth frequency response curve may be formed, which avoids the appearance of excessively high resonance peaks at low or high frequencies, thereby obtaining an ideal frequency response within the entire sound band. Similarly, the material and thickness of the contact surface 1601 may also affect the sound transmission, thereby affecting the sound quality effect. For example, when the material of the contact surface is soft, the sound wave transmission effect in the low frequency range may be better than in the high frequency range, when the material of the contact surface is hard, the sound wave transmission effect in the high frequency range may be better than in the low frequency range.

Figure 20:
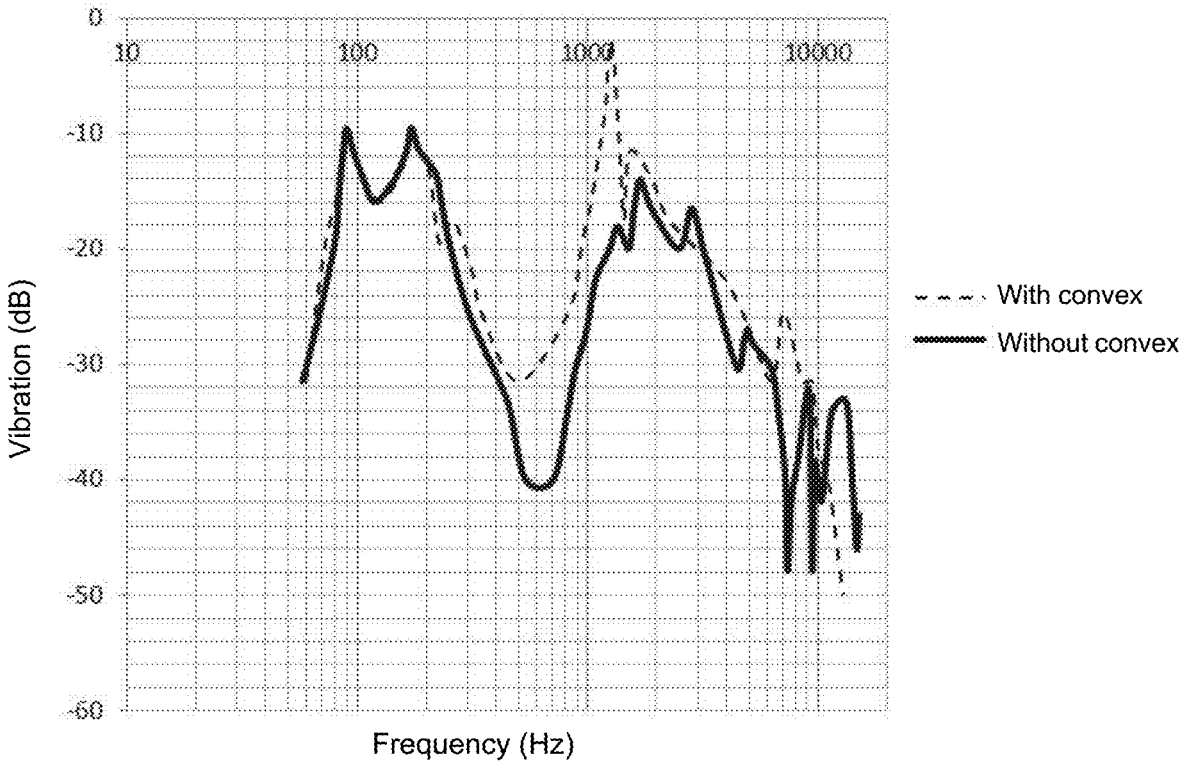
FIG. 20 is a vibration response curve of an MP3 player according to some embodiments of the present disclosure.

FIG. 20 shows the frequency response of MP3 players containing different contact surfaces. The dotted line may correspond to the frequency response of an MP3 player with a convex structure on the contact surface, and the solid line may correspond to the frequency response of an MP3 player without a convex structure on the contact surface. In the mid-low frequency range (for example, in the range of 300 Hz to 1000 Hz), the vibration of the structure with a convex may be significantly weakened relative to that with the convex structure, which forms a "deep pit" on the frequency response curve and appears to be a less than ideal frequency response, thereby affecting the sound quality of the MP3 player.

The above description of FIG. 20 is only an explanation for a specific example. For those skilled in the art, after understanding the basic principles that affect the frequency response of MP3 players, various modifications and alterations can be made to the structure and components of loudspeaker to obtain different frequency response effects.

It should be noted that, for those skilled in the art, the shape and structure of the contact surface 1601 is not limited to the above description, and may satisfy other specific requirements. For example, the convex or concave portions on the contact surface may be distributed on the edge of the contact surface or may be distributed in the middle of the contact surface. The contact surface may include one or more convex or concave portions, and the convex and concave portions may be distributed on the contact surface at the same time. The material of the convex or concave part of the contact surface may be other materials different from the material of the contact surface, it may be flexible, rigid, or a material more suitable for generating a specific pressure gradient; it may either be a memory material or a non-memory material; it may be a single-material material or a composite material. The structural graphics of the convex or concave part of the contact surface may include but not limited to axisymmetric graphics, center-symmetric graphics, rotationally-symmetric graphics, and asymmetric graphics. The structural graphic of the convex or concave portion of the contact surface may be two or more combinations of graphics. The contact surface may include but not limited to a certain degree of smoothness, roughness, and waviness. The position distribution of the convex or concave portion of the contact surface may include but not limited to axisymmetric, center-symmetric, rotationally-symmetric, and asymmetric distribution. The convex or concave part of the contact surface may be at the edge of the contact surface, and may also be distributed inside the contact surface.

Figure 21:
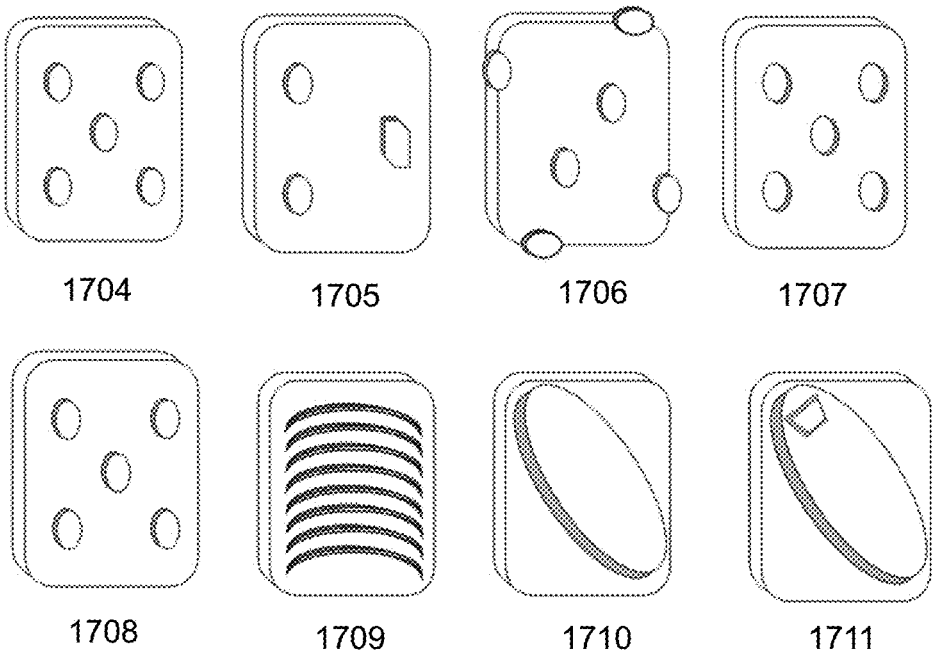
FIG. 21 is a schematic diagram illustrating a vibration unit contact surface of an MP3 player according to some embodiments of the present disclosure.

FIG. 21 is a schematic diagram illustrating a vibration unit contact surface of an MP3 player according to some embodiments of the present disclosure. FIG. 21 shows various exemplary contact surface structures. 1704 shown in the figure may be an example in which the contact surface contains various convexities with similar shapes and structures. The convexities may be made of the same or similar materials as the other parts of the panel, and may also be made of materials different from the other parts. In particular, the convexities may include a memory material and a vibration transmission layer material, wherein the proportion of the memory material may not be less than 10%, and preferably, the proportion of the memory material in the convexities may not be less than 50%. The area of a single convex may occupy 1%-80% of the total area, preferably, the proportion of the total area may be 5%-70%, and more preferably, the proportion of the total area may be 8%-40%. The area of all the convexities collectively may account for 5%-80% of the total area, and preferably, the ratio may be 10%-60%. There may be at least one convex, preferably, there may be one convex, more preferably, there may be two convexities, and even more preferably, there may be at least five convexities. The shape of the convexities may be a circle, an oval, a triangle, a rectangle, a trapezoid, an irregular polygon, or other similar graphics, the structure of the convexities may be symmetrical or asymmetrical, and the position distribution of the convex parts may be symmetrical or asymmetrical, the number of convex parts may be one or more, the height of the convexities may be the same or may not the same, the height and distribution of the convexities may form a certain gradient.

1705 shown in the figure may be an example in which the structure of the convexities of the contact surface may be a combination of two or more figures, where the number of the convexities in different figures may be one or more. The two or more convexities shapes may be any two or more combinations of circles, ovals, triangles, rectangles, trapezoids, irregular polygons, or shapes in other similar graphics. The material, number, area, and symmetry of the convexities may be similar to 1704 in the figure.

1706 shown in the figure may be an example in which the convex portions of the contact surface may be distributed on the edges and inside of the contact surface, and the number of the convex portions may not be limited to that shown in the figure. The number of the convexities at the edge of the contact surface may account for 1%-80% of the total number of convexities, preferably, the proportion may be 5%-70%, more preferably, the ratio may be 10%-50%, and even more preferably, the ratio may be 30%-40%. The material, number, area, shape, symmetry, etc. of the convexities may be similar to those in FIG. 1704.

1707 in the figure may be a structural graphic of the concave portion of the contact surface, the structure of the concave portion may be symmetrical or asymmetrical, and the position distribution of the concave portion may also be symmetrical or asymmetrical. The number of the concave portions may be one or more, the shape of the concave portions may be the same or different, and the concave portions may be hollow. The area of a single recess may occupy 1%-80% of the total area, preferably, the proportion of the total area may be 5%-70%, and more preferably, the proportion of the total area may be 8%-40%. All the concave areas may together account for 5%-80% of the total area, and preferably, the ratio may be 10%-60%. There may be at least one concave, preferably, there may be one concave, more preferably, there may be two concaves, and even more preferably, there may be at least five concaves. The shape of the concaves may be a circle, an oval, a triangle, a rectangle, a trapezoid, an irregular polygon, or other similar graphics.

1708 in the figure may be an example in which both the convex portion and the concave portion may exist on the contact surface, and the number of convexities and concave portions may not be limited to one or more. The ratio of the number of concaves to the number of convexities may be 0.1-100, preferably, the ratio may be 1-80, more preferably, the ratio may be 5-60, and even more preferably, the ratio may be 10-20. The material, area, shape, symmetry, etc. of the single convexities/concaves may be similar to 1704 in the figure.

1709 in the figure may be an example of a contact surface with a certain degree of waviness. The corrugation may be formed by more than two convexities/concaves or a combination of both, preferably, the distances between the adjacent convexities/concaves may be equal, more preferably, the distances between the convexities/concaves may be set in an progression manner.

1710 in the figure may be an example in which the contact surface has a large area of convex. The convex area may account for 30%-80% of the total area of the contact surface. Preferably, a portion of the edge of the convex and a portion of the edge of the contact surface may substantially contact each other.

1711 in the figure may be a contact surface with a first convex with a larger area and a second convex with a smaller area on the first convex. The convex with a larger area may account for 30%-80% of the total area of the contact surface, and the convex with a smaller area may account for 1%-30% of the total area of the contact surface. Preferably, the proportion may be 5%-20%. The smaller area may account for 5%-80% of the larger area, preferably, the ratio may be 10%-30%.

The above description of the structure of the MP3 player interface may just be a specific example and should not be considered as the only feasible implementation. Obviously, for those skilled in the art, after understanding the basic principle that the MP3 player contact surface structure may affect the sound quality of the MP3 player, it is possible to make various modifications and alterations in the specific form and details of implementing the working process of the bone conduction MP3 player contact surface without this principle, but these modifications and alterations are still within the scope described above. For example, the number of convexities or concaves may not be limited to those shown in FIG. 21, the surface patterns of the convexities, concaves or contact surfaces described above may also be modified to a certain extent, the modifications may still be within the scope of protection described above. Moreover, the contact surface of at least one or more vibration units in the MP3 player may use the same or different shapes and materials, the vibration effects transmitted on different contact surfaces may also vary according to the nature of the contact surface, and finally obtain different sound quality effects.

Figure 22:
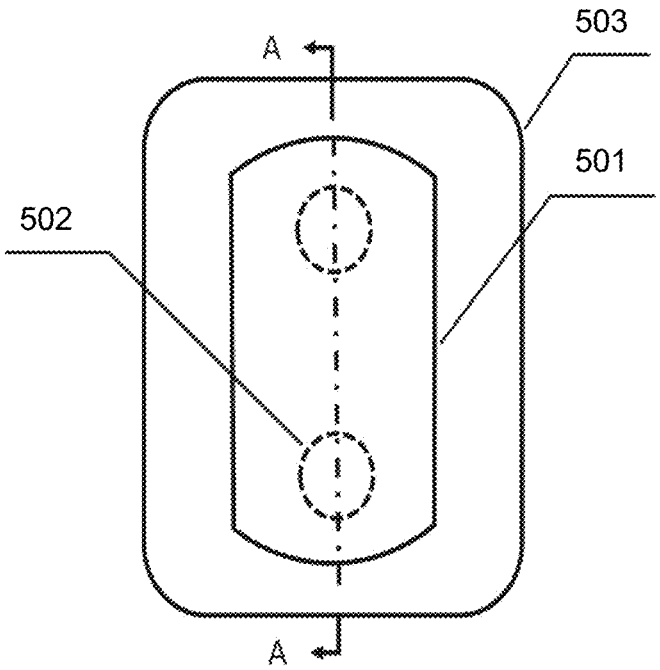
FIG. 22 is a top view illustrating a bonding panel of an MP3 player according to some embodiments of the present disclosure.
Figure 23:
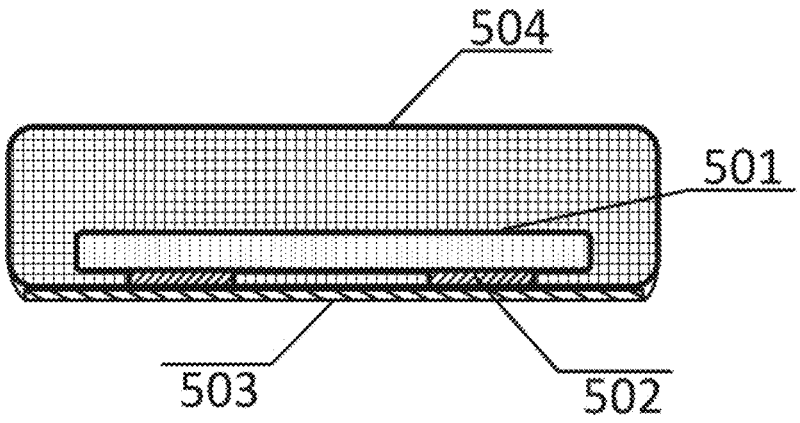
FIG. 23 is a side view illustrating a bonding panel of an MP3 player according to some embodiments of the present disclosure.

FIG. 22 is a top view illustrating a connection of a panel and a vibration transmission layer, and FIG. 23 is a side view and a side view illustrating a connection of a panel and a vibration transmission layer.

In some embodiments, the vibration transmission layer may be provided at the outer surface of the side wall of the earphone core housings 20 that is in contact with the human body. The vibration transmission layer in this embodiment may be a specific embodiment of changing the physical characteristics of the contact surface of the vibration unit to change the sound transmission effect. Different regions on the vibration transmission layer may have different transmission effects on vibration. For example, a first contact surface region and a second contact surface region may exist on the vibration transmission layer, preferably, the first contact surface region may not be attached to the panel, and the second contact surface region may be attached to the panel; more preferably, when the vibration transmitting layer is in direct or indirect contact with the user, the clamping force on the first contact surface region may be less than that on the second contact surface region (the clamping force mentioned here may refer to the pressure between the contact surface of the vibration unit and the user); further preferably, the first contact surface region may not be in direct contact with the user, and the second contact surface region may be in direct contact with the user and transmit vibration. The area of the first contact surface region may be different from that of the second contact surface region, preferably, the area of the first contact surface region may be less than that of the second contact surface region; more preferably, there may be small holes in the first contact surface region to further reduce the area of the first contact region; the outer surface of the vibration transmission layer (that is, the surface facing the user) may be flat or may be uneven, preferably, the first contact surface region and the second contact surface region may be not on a same plane; more preferably, the second contact surface region may be higher than the first contact surface region; further preferably, the second contact surface region and the first contact surface region may constitute a step structure; still further preferably, the first contact surface region may be in contact with the user, and the second contact surface region may not be in contact with the user. The materials of the first contact surface region and the second contact surface region may be the same or different, and may be one or more combination of the vibration transmission layer materials described above. The above descriptions of the clamping force on the contact surface may be only a manifestation of the present disclosure. Those skilled in the art may modify the structure and manner described above according to actual needs, and these modifications are still within the protection scope of the present disclosure. For example, the vibration transmission layer may not be necessary, the panel may directly contact the user, and a different contact surface region may be provided on the panel, different contact regions may have similar properties to the first contact region and the second contact region described above. For another example, a third contact surface region may be set on the contact surface, the third contact surface region may be provided with structures different from the first contact surface region and the second contact surface region, and these structures may achieve certain effects in reducing the shell vibration, suppressing sound leakage, and improving the frequency response curve of the vibration unit.

As shown in FIGS. 22 and 23, in some embodiments, the panel 501 and the vibration transmission layer 503 may be bonded by glues 502, the glued joints may be located at both ends of the panel 501, and the panel 501 may be located in a housing formed by the vibration transmitting layer 503 and the housing 504. Preferably, the projection of the panel 501 on the vibration transmission layer 503 may be a first contact surface region, and region located around the first contact surface region may be a second contact surface region.

Figure 24:
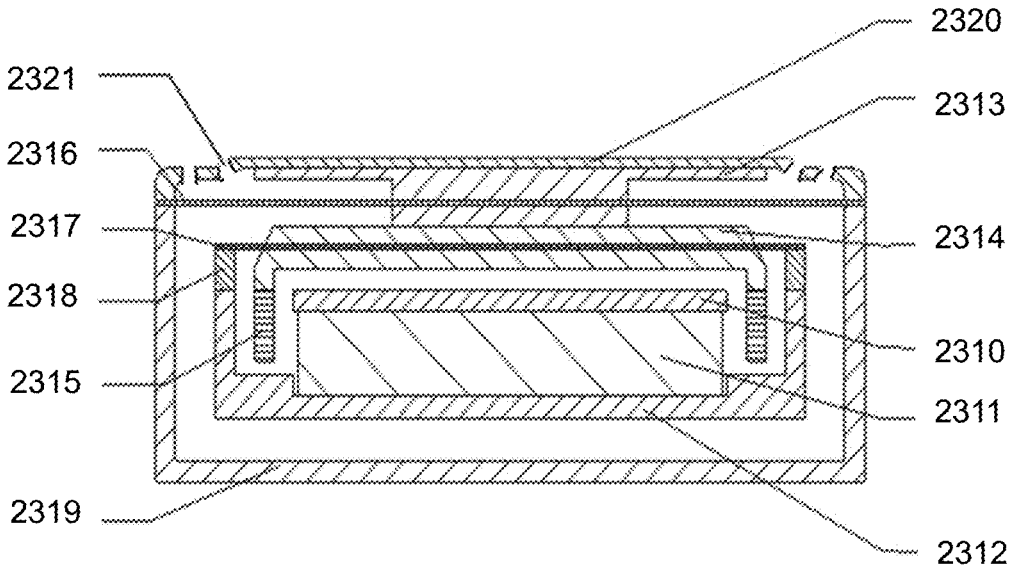
FIG. 24 is a structural diagram illustrating a vibration generating portion of an MP3 player according to some embodiments of the present disclosure.

As a specific embodiment, as shown in FIG. 24, the earphone core may include a magnetic circuit system including a magnet 2311, a magnetic conductive plate 2310, and a magnetizer 2312. The earphone core may also include a vibration sheet 2314, a coil 2315, a first vibration conducting sheet 2316, a second vibration conducting sheet 2317, and a washer 2318. The panel 2313 may protrude out of the housing 2319 and bond with the vibration sheet 2314 by glues, the first vibration conducting sheet 2316 may fix the earphone core on the housing 2319 to form a suspension structure. A vibration transmission layer 2320 (such as but not limited to silica gel) may be added to the panel 2313, and the vibration transmission layer 2320 may generate a certain deformation to adapt to the skin shape. A portion of the vibration transmission layer 2320 that is in contact with the panel 2313 may be higher than a portion of the vibration transmission layer 2320 that is not in contact with the panel 2313, forming a step structure. One or more guiding holes 2321 may be designed in a portion where the vibration transmission layer 2320 does not contact with the panel 2313 (the portion where the vibration transmission layer 2320 does not protrude in FIG. 24). Designing guiding holes in the vibration transmission layer may reduce sound leakage: the connection between the panel 2313 and the housing 2319 through the vibration transmission layer 2320 may be weakened, and the vibration transmitted from the panel 2313 to the housing 2319 through the vibration transmission layer 2320 may be reduced, thereby reducing the sound leakage caused by the vibration of the housing 2319; the area of the non-protruding part of the vibration transmission layer 2320 may be reduced by providing guiding holes 2321, reducing the amount of air that can be actuated, and reducing the sound leakage caused by air vibration; after the guiding holes 2321 are provided in the non-protruding part of the vibration transmission layer 2320, the air vibration in the housing may be guided out of the housing, and the air vibration caused by the housing 2319 may cancel each other out, and reduce sound leakage. It should be noted that, since the guiding holes 2321 lead out the sound waves in the composite vibration apparatus housing, and superimpose with the sound leakage sound wave to reduce the sound leakage, the guiding holes may also be called the sound guiding hole.

What needs to be explained here is that, in this embodiment, since the panel protrudes out of the MP3 player housing, and at the same time, the first vibration conducting sheet may be used to connect the panel to the MP3 player housing, the degree of coupling between the panel and the housing may be greatly reduced, and the first vibration conducting sheet may provide a certain amount of deformation, so that the panel may have a higher degree of freedom when it attaches the user to better adapt to complex skin surfaces, the first vibration conducting sheet may cause the panel to incline at a certain angle relative to the housing. Preferably, the angle of inclination may not exceed 5 degrees.

Figure 25:
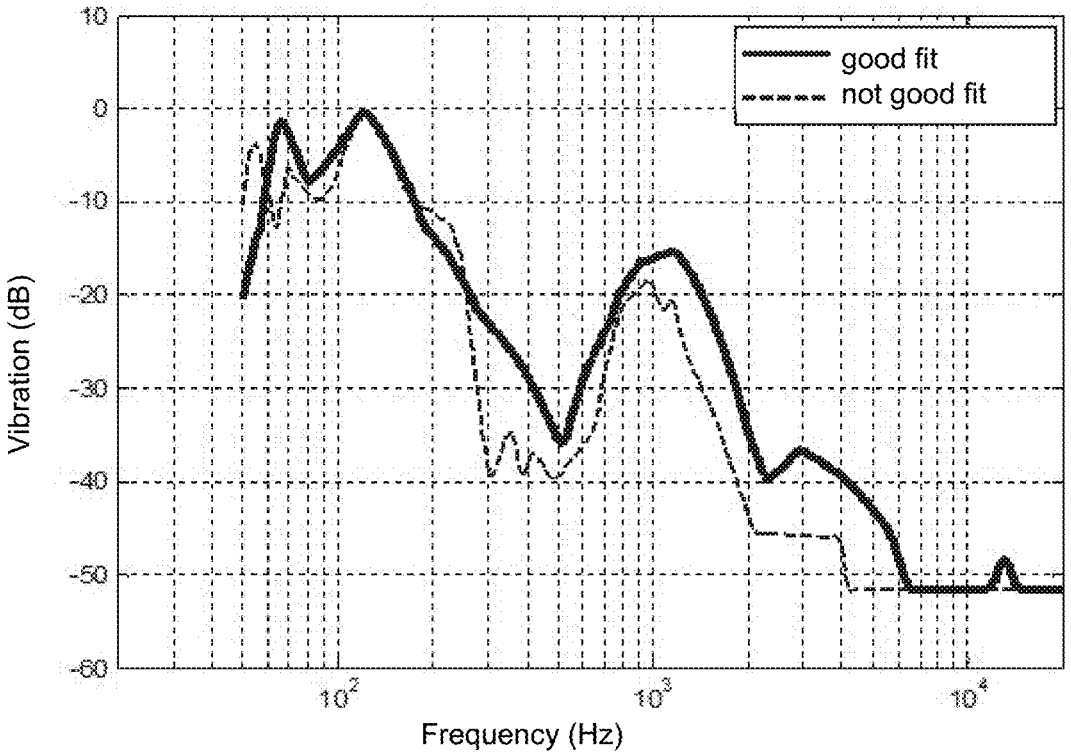
FIG. 25 is a vibration response graph of a vibration generating portion of an MP3 player according to some embodiments of the present disclosure.

Further, the vibration efficiency of the MP3 player may vary with the bonding states. A good bonding state may have higher vibration transmission efficiency. As shown in FIG. 25, the thick line may show the vibration transmission efficiency in a good bounding state, and the thin line shows the vibration transmission efficiency in a bad bounding state, it may be seen that the better bounding state may have higher vibration transmission efficiency.

Figure 26:
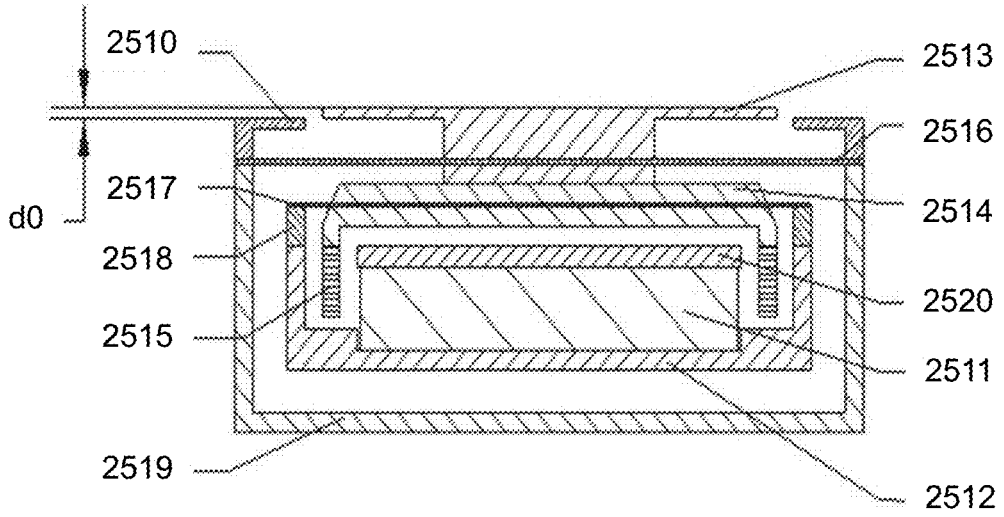
FIG. 26 is a structural diagram illustrating a vibration generating portion of an MP3 player according to some embodiments of the present disclosure.

FIG. 26 is a structural diagram illustrating a vibration generating portion of an MP3 player according to some embodiments of the present disclosure. As shown in FIG. 26, as a specific embodiment, in this embodiment, the earphone core may include a magnetic circuit system including a magnetic conductive plate 2520, a magnet 2511, and a magnetic conductive magnet 2512. The earphone core may also include a vibration sheet 2514, coils 2515, a first vibration conducting sheet 2516, a second vibration conducting sheet 2517, and a washer 2518. The panel 2513 may protrude out of the housing 2519 and bond with the vibration sheet 2514 by glues, and the first vibration conducting sheet 2516 may fix and connect the earphone core to the housing 2519 to form a suspension structure.

The difference between this embodiment and the embodiment provided in the FIG. 24 may lie in: an enclosure may be added to the edge of the housing, during the process of the housing contacting the skin, the enclosure may make the force distribution more uniform, and increase the wearing comfort of the MP3 player. There is a height difference d0 between the surrounding edge 2510 and the panel 2513. The force of the skin acting on the panel 2513 may reduce the distance between the panel 2513 and the surrounding edge 2510. When the pressure between the MP3 player and the user is greater than the force experienced when the first vibration conducting sheet 2516 is deformed into d0, excessive clamping force may be transmitted to the skin through the surrounding edge 2510 without affecting the clamping force of the vibrating part, making the clamping force more consistent, thereby ensuring sound quality.

Under normal circumstances, the sound quality of MP3 players may be affected by many factors such as the physical properties of the components of the MP3 player itself, the vibration transmission relationship between the components, the vibration transmission relationship between the MP3 player and the outside world, and the efficiency of the vibration transmission system when transmitting vibrations. The components of the MP3 player itself may include components generating vibration (such as but not limited to earphone core), components fixing the MP3 player (such as, but not limited to ear hooks 10), and components transmitting vibration (such as but not limited to panels, vibration transmission layers, etc.). The vibration transmission relationship between the various components and the vibration transmission relationship between the MP3 player and the outside world may be determined by the contact method (such as but not limited to clamping force, a contact area, a contact shape, etc.) between the MP3 player and the user.

It should be noted that the above description of the MP3 player is only a specific example and should not be considered as an only feasible implementation solution. Obviously, for those skilled in the art, after understanding the basic principles of MP3 players, it is possible to make various modifications and alterations in the specific form and details of implementing the working process of the MP3 player without departing from this principle, but these modifications and alterations are still within the scope described above. For example, the vibration transmission layer may not limited to one layer shown in FIG. 24, but may also be multiple layers, and the specific number of layers may be determined according to actual conditions, the specific number of layers of the vibration transmission layer in the present disclosure may not be specifically limited herein. As another example, the step structure formed between the vibration transmission layer and the panel may not be limited to one structure in FIG. 24, when there are a plurality of vibration transmission layers, a stepped structure may be formed between each vibration transmission layers and the panel and between each vibration transmission layers. All such variations are within the protection scope of the present disclosure.

Figure 27:
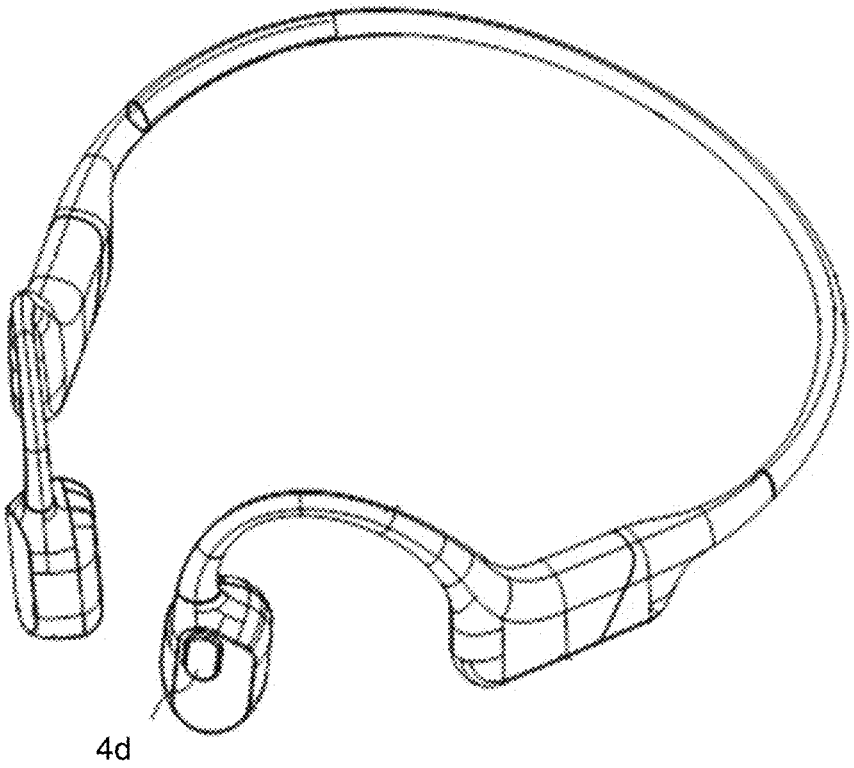
FIG. 27 is a structural diagram illustrating a key module of an MP3 player according to some embodiments of the present disclosure.

FIG. 27 is a structural diagram illustrating a key module of an MP3 player according to some embodiments of the present disclosure. As shown in FIG. 27, in some embodiments, the MP3 player may further include a key module. In some embodiments, the key module may include a power key, a functional shortcut key, and a menu shortcut key. In some embodiments, the functional shortcut keys may include a volume plus key and a volume minus key for adjusting the sound volume, a fast forward key and a rewind key for adjusting the progress of the sound file, and keys for controlling the connection of the MP3 player with external devices (for example, a Bluetooth connection). In some embodiments, the key module may include two forms: a physical key and a virtual key. For example, when the key module exists in the form of a physical key, the key may be disposed at the auxiliary side wall 34 and/or the first side wall 30*a* of a circuit housing 30. When the user wears the MP3 player described in this embodiment, the auxiliary side wall 34 and the first side wall 30*a* may not be in contact with human skin, and may be exposed on the outside to facilitate the user's wearing and operation on each key. In some embodiments, an end surface of each key in the key module may be provided with an identifier corresponding to its function. In some embodiments, the identifier may include text (for example, Chinese and English), and symbols (for example, the volume plus key may be marked with "+", and the volume minus key may be marked with "−"). In some embodiments, the logo may be set at the key by means of laser printing, screen printing, pad printing, laser filler, thermal sublimation, and hollow text. In some embodiments, the logo on the button may also be set on the surface of the circuit housing 30 on the periphery of the button, and may also serve as a label. In some embodiments, a touch screen may be selected as the MP3 player, and the control programs installed in the MP3 player may generate a virtual key on a touch screen with an interactive function, and the virtual key may select a function, a volume, and a file of the player. In addition, the MP3 player may also be a combination of physical display and physical buttons.

In some embodiments, as shown in FIG. 27, at least one key module 4*d* may be set at an earphone core housing of the MP3 player, and the key module 4*d* may be used for interaction. For example: implementing pausing/starting, recording, answering calls operations, etc. It should be known that the key module 4*d* shown in the figure is only for the purpose of illustration, those skilled in the art may adjust parameters such as the position, number, and shape of the key module on the basis of fully understanding the function of the key module. For example, the key module 4*d* may also be set at the circuit housing 30 or other positions of the MP3 player.

In some embodiments, the key module 4*d* may implement different interactive functions based on the user's operation instructions, for example: click the key module 4*d* once to implement pausing/starting (such as music, recording, etc.); quickly click the button module 4*d* twice to implement answering the call; click regularly (for example, click once every second and click twice in total) to implement the recording function. In some embodiments, the user's operation instruction may be an operation such as clicking, swiping, scrolling, or a combination thereof. For example, sliding up and down on the surface of the key module 4*d* to achieve the function of turning up/down the volume.

In another example, there may be at least two key module 4*d* corresponding to two earphone core housings 20 on the left and right sides, respectively. The user may use the left and right hands to operate the key module 4*d* to improve the user experience, respectively.

In an application scenario, in order to further improve the interaction experience, the functions of interaction may be assigned to the key modules 4*d* on the left and right sides, and the user may operate the key modules 4*d* corresponding to different functions. For example, on the button module 4*d* on the left: clicking once to turn on the recording function and clicking again to turn off the recording function; clicking twice quickly to implement the pause/play function. Quickly clicking twice on the button module 4*d* on the right may implement the function of answering calls (if music is being played at this time and there is no call access, it may implement the next/previous song switch function).

In some embodiments, the functions corresponding to the left and right button modules 4*d* may be user-defined. For example, the user may assign the pause/play function performed by the left button module 4*d* to the right button module 4*d* by applying software settings; or assign a call answering function performed by the right key module 4*d* to the left key module 4*d*. In addition, the operation instructions (such as the number of clicks and swiping gestures) configured to achieve the corresponding function may also be set by the user through the application softwares. For example, the operation instruction corresponding to the function of answering a call may be set from one click to two clicks, and the operation instruction corresponding to the switch to the next/previous song function may be set from two clicks to three clicks. User-defined operations may be more in line with the user's operating habits, which avoids operating errors and improving user experience to some extent.

In some embodiments, the interaction function may not be unique, and may be set according to functions commonly used by users. For example, the key module 4*d* may also implement functions such as rejecting calls and reading voice messages, and users may customize the functions and operation instructions corresponding to the functions to meet different needs.

In some embodiments, the MP3 player may be connected to an external device through at least one key module. For example, the MP3 player may be connected to a mobile phone through a button on the MP3 player that controls a wireless connection (for example, a button that controls a Bluetooth connection). Optionally, when the connection is established, the user may directly operate the MP3 player on the external device (for example, a mobile phone) to implement one or more functions mentioned above.

It should be noted that the above description of the MP3 player is merely a specific example and should not be considered as a merely feasible implementation solution. Obviously, for those skilled in the art, after understanding the basic principles of MP3 players, it is possible to make various modifications and alterations in the form and details of the specific methods and steps of implementing the working process of the MP3 player without departing from this principle, but these modifications and alterations are still within the scope described above. For example, the shape of the key may be a regular shape such as a rectangle, a circle, an oval, or a triangle or an irregular shape. As another example, the shape of each key may be the same or different. All such variations are within the protection scope of the present disclosure.

Figure 28:
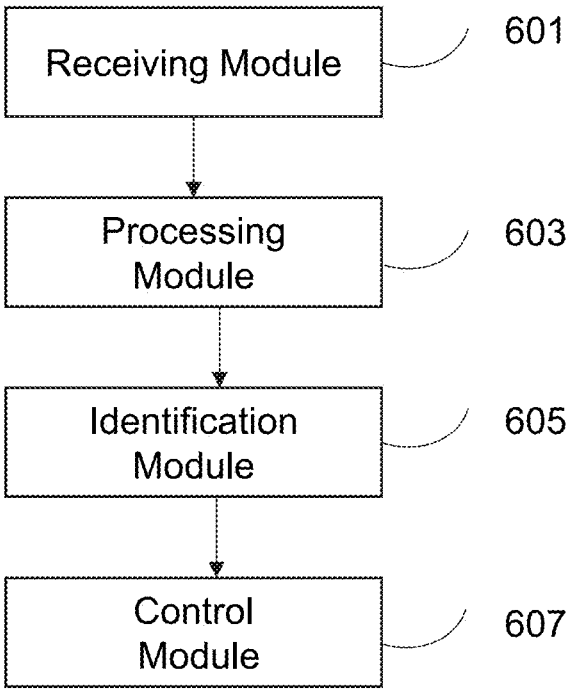
FIG. 28 is a framework diagram illustrating a voice control system according to some embodiments of the present disclosure.

FIG. 28 is a framework diagram illustrating a voice control system according to some embodiments of the present disclosure. In some embodiments, the MP3 player may further include a voice control system. The voice control system may be part of the auxiliary key module, and may also be integrated in the MP3 player as a separate module. As shown in FIG. 28, in some embodiments, the voice control system may include a receiving module 601, a processing module 603, an identification module 605, and a control module 607.

In some embodiments, the receiving module 601 may be configured to receive voice control instruction and send the voice control instruction to the processing module 603. In some embodiments, the receiving module 601 may be one or more microphones. In some embodiments, when the receiving module 601 receives a voice control instruction issued by a user, for example, when the receiving module 601 receives a voice control instruction of "start playing", the voice control instruction may be sent to the processing module 603.

In some embodiments, the processing module 603 may be communicatively connected with the receiving module 601, generate instruction signal according to the voice control instruction, and send the instruction signal to the identification module 605.

In some embodiments, when the processing module 603 receives a voice control instruction issued by the current user from the receiving module 601 through a communication connection, it may generate an instruction signal according to the voice control instruction.

In some embodiments, the identification module 605 may be communicatively connected with the processing module 603 and the control module 607 to identify whether the instruction signal matches a preset signal and send a matching result to the control module 607.

In some embodiments, when the identification module 605 determines that the instruction signal matches the preset signal, the identification module 605 may send the matching result to the control module 607. The control module 607 may control the operation of the MP3 player according to the instruction signal. For example, when the receiving module 601 receives a voice control instruction of "start playing", and when the identification module 605 determines that the command signal corresponding to the voice control instruction match a preset signal, the control module 607 may automatically execute the voice control instruction, that is, immediately start playing sound data. When the command signal does not match the preset signal, the control module 607 may not execute the control command.

In some embodiments, the voice control system may further include a storage module, which is communicatively connected with the receiving module 601, the processing module 603, and the identification module 605; the receiving module 601 may receive a preset voice control instruction and send it to the processing module 603; the processing module 603 may generate a preset signal according to the preset voice control instruction, and send the preset signal to the storage module. When the identification module 605 needs to match the instruction signal received by the receiving module 601 with the preset signal, the storage module may send the preset signal to the identification module 605 through a communication connection.

In some embodiments, processing module 603 may further include removing ambient sounds included in the voice control instructions.

In some embodiments, the processing module 603 in the voice control system in this embodiment may further include a process of denoising the voice control instructions. The denoising process may refer to removing the ambient sound included in the voice control instruction. In some embodiments, for example, when in a complex environment, the receiving module 601 may receive the voice control instruction and send it to the processing module 603, before generating a corresponding instruction signal according to the voice control instruction, in order to avoid ambient sounds from disturbing the recognition process of the subsequent identification module 605, the processing module 603 may perform denoising process on the voice control instruction. For example, when the receiving module 601 receives a voice control instruction issued by a user when the user is on an outdoor road, the voice control instruction may include noisy environmental sounds such as vehicle driving, whistle on the road, and the processing module 602 may reduce the influence of the environmental sound on the voice control instruction through denoising processing.

It should be noted that the above description of the voice control system is merely a specific example and should not be considered as merely a feasible implementation solution. Obviously, for those skilled in the art, after understanding the basic principles of the voice control system, it is possible to make various modifications and alterations in the form and details of the specific manner and steps of implementing the voice control system without departing from this principle, but these modifications and alterations are still within the scope described above. For example, the receiving module and the processing module may be independent modules, and may also be the same module. All such variations are within the protection scope of the present disclosure.

In some embodiments, the loudspeaker (e.g., an MP3 player) described above may also transmit the sound to the user through air conduction. When the sound is transmitted by air, the loudspeaker may include one or more sound sources. The sound source may be located at a specific position of the user's head, for example, the top of the head, forehead, cheeks, cheek horns, auricle, back of auricle, etc., without blocking or covering the ear canal. For the purpose of description, FIG. 29 shows a schematic diagram illustrating a method for transmitting sound through air conduction.

Figure 29:
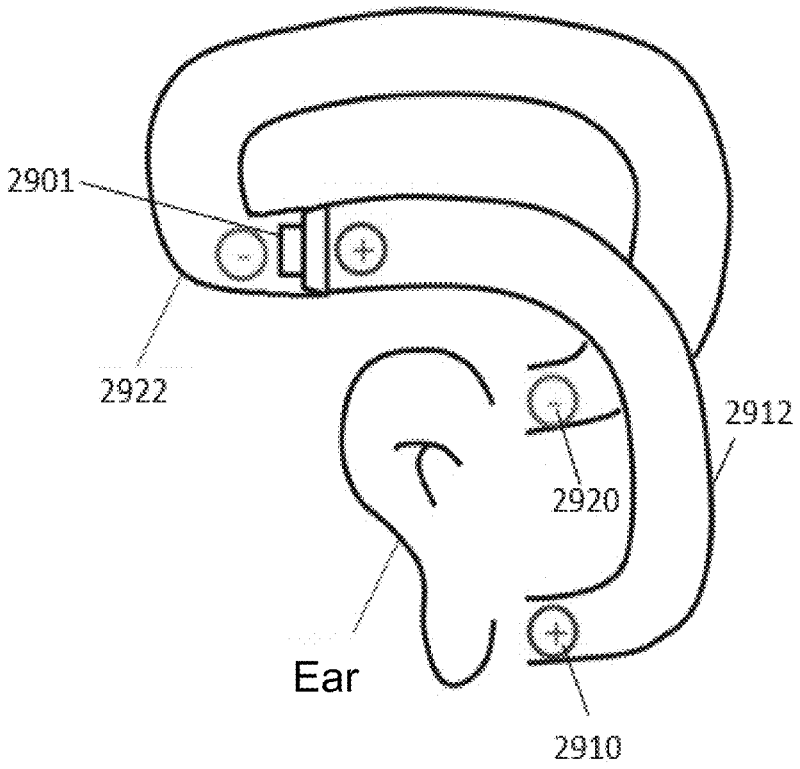
FIG. 29 is a schematic diagram illustrating a method for transmitting sound through air conduction according to some embodiments of the present disclosure.

As shown in FIG. 29, the sound source 2910 and the sound source 2920 may generate sound waves with opposite phases ("+" and "−" in the figure indicate opposite phases). For simplicity, the sound source mentioned here may refer to a sound outlet on the loudspeaker. For example, the sound source 2910 and the sound source 2920 may be two sound outlets located at a specific position on the MP3 player (for example, an earphone core housing 20, or a circuit housing 30), respectively.

In some embodiments, the sound source 2910 and the sound source 2920 may be generated by a same vibration apparatus 2901. The vibration apparatus 2901 may include a diaphragm (not shown in the figure). When the diaphragm is driven by electric signals to vibrate, the front of the diaphragm may drive air to vibrate, and the sound source 2910 may be formed at the sound outlet through a sound guide channel 2912; the back of the diaphragm may also drive air to vibrate, and the sound source 2920 may be formed at the sound outlet through a sound guide channel 2922. The sound guide channel may refer to a sound propagation route from the diaphragm to the corresponding sound outlet. In some embodiments, the sound guiding channel may be a route surrounded by a specific structure (for example, an earphone core housing 20, or a circuit housing 30) on the loudspeaker. It needs to be known that in some alternative embodiments, the sound source 2910 and the sound source 2920 may also be generated by different vibration apparatuses, which are generated by different diaphragm vibrations, respectively.

Among the sounds generated by the sound source 2910 and the sound source 2920, part of the sound may be transmitted to the user's ear to form the sound heard by the user, and the other part may be transmitted to the environment to form a leaked sound. Considering that the sound source 2910 and the sound source 2920 are relatively close to the user's ear, for convenience of description, the sound transmitted to the user's ear may be called near-field sound, and the leaked sound transmitted to the environment may be called far-field sound. In some embodiments, the near-field or far-field sound of different frequencies generated by the loudspeaker may be related to the distance between the sound source 2910 and the sound source 2920. Generally speaking, the near-field sound generated by the loudspeaker may increase as the distance between the two sound sources increases, and the far-field sound (leakage) generated by the loudspeaker may increase as the frequency increases.

For the sounds of different frequencies, the distance between the sound source 2910 and the sound source 2920 may be designed separately, so that the low-frequency near-field sound (for example, sound with a frequency less than 800 Hz) generated by the loudspeaker may be as large as possible, and the high-frequency far-field sound (for example, a sound with a frequency greater than 2000 Hz) may be as small as possible. In order to achieve the above purpose, the loudspeaker may include two or more sets of dual sound sources, each set of dual sound source may include two sound sources similar to the sound source 2910 and the sound source 2920, and generate sound with specific frequencies, respectively. Specifically, the first set of dual sound sources may be configured to generate low frequency sounds, and the second set of dual sound sources may be configured to generate high frequency sounds. In order to obtain a large low-frequency near-field sound, the distance between two sound sources in the first set of dual sound sources may be set to a larger value. And since the low-frequency signal has a longer wave length, a larger distance between the two sound sources may not cause an excessive phase difference in the far field, which may not form too much sound leakage in the far field. In order to make the high-frequency far-field sound smaller, the distance between two sound sources in the second set of dual sound sources may be set to a smaller value. Since the high-frequency signal has a shorter wave length, a smaller distance between the two sound sources may avoid the formation of a large phase difference in the far field, and thus may avoid the formation of large sound leakage. The distance between the second set of dual sound sources may be less than that between the first group of dual sound sources.

The beneficial effects that the present disclosure embodiment may bring include but not limited to: (1) the protection sleeve at the ear hooks may flexibly abut against the earphone core housing, which improves the waterproof performance of the loudspeaker; (2) by adopting different molds to mold the ear hooks and the earphone core housing, separately, the size of the mold may be reduced, thereby reducing the processing difficulty of the mold and the molding difficulty in manufacturing the ear hooks and the earphone core housings 20; (3) adopting a composite vibration apparatus and a contact surface with a gradient structure may improve the sound transmission effect and improve the sound quality; (4) adopting a panel with at least one contact surface and providing sound guiding holes may reduce housing vibration and suppress sound leakage; (5) the elastic metal wire used in ear hooks may have a certain degree of elasticity, and may be adapted to users with different ear types and head types. It should be noted that different embodiments may have different beneficial effects. In different embodiments, the possible beneficial effects may be any of the above or the like, or any combination thereof, or may be any other beneficial effects that may be obtained.

The basic concepts have been described above. Obviously, for those skilled in the art, the disclosure of the invention is merely by way of example, and does not constitute a limitation on the present disclosure. Although not explicitly stated here, those skilled in the art may make various modifications, improvements and alterations to the present disclosure. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure or characteristic described in connection with the embodiment is included in at least one embodiment of the present disclosure. Therefore, it is emphasized and should be appreciated that two or more references to "an embodiment" or "one embodiment" or "an alternative embodiment" in various parts of this specification are not necessarily all referring to the same embodiment. In addition, some features, structures, or features in the present disclosure of one or more embodiments may be appropriately combined.

In addition, those skilled in the art may understand that various aspects of the present disclosure may be illustrated and described through several patentable categories or situations, including any new and useful processes, machines, products or combinations of materials or any new and useful improvements to them. Accordingly, all aspects of the present disclosure may be performed entirely by hardware, may be performed entirely by softwares (including firmware, resident softwares, microcode, etc.), or may be performed by a combination of hardware and softwares. The above hardware or softwares can be called "module", "unit", "component" or "system". In addition, aspects of the present disclosure may appear as a computer product located in one or more computer-readable media, the product including computer-readable program code.

Furthermore, the recited order of processing elements or sequences, or the use of numbers, letters, or other designations therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose, and that the appended claims may not limited to the disclosed embodiments, but on the contrary, are intended to cover modifications and equivalent arrangements that are within the spirit and scope of the disclosed embodiments. For example, although the implementation of various components described above may be embodied in a hardware device, it may also be implemented as a software only solution, e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. However, this disclosure method does not mean that the present disclosure object requires more features than the features mentioned in the claims. Rather, claimed subject matter may lie in less than all features of a single foregoing disclosed embodiment.

In some embodiments, the numbers expressing quantities of ingredients, properties, and so forth, used to describe and claim certain embodiments of the application are to be understood as being modified in some instances by the term "about," "approximate," or "substantially", etc. Unless otherwise stated, "about," "approximate," or "substantially" may indicate ±20% variation of the value it describes. Accordingly, in some embodiments, the numerical parameters set forth in the description and attached claims are approximations that may vary depending upon the desired properties sought to be obtained by a particular embodiment.

In some embodiments, numerical data should take into account the specified significant digits and use a method reserved for general digits. Notwithstanding that the numerical ranges and parameters configured to illustrate the broad scope of some embodiments of the present disclosure are approximations, the numerical values in specific examples may be as accurate as possible within a practical scope.

At last, it should be understood that the embodiments described in the present application are merely illustrative of the principles of the embodiments of the present application. Other modifications that may be employed may be within the scope of the application. Thus, by way of example, but not of limitation, alternative configurations of the embodiments of the application may be utilized in accordance with the teachings herein. Accordingly, embodiments of the present disclosure are not limited to the embodiments that are expressly introduced and described herein.

What is claimed is:

1. A loudspeaker, comprising:

an ear hook, including a first plug end and a second plug end, the ear hook being surrounded by a protection sleeve, the protection sleeve being made of an elastic waterproof material;

an earphone core housing configured to accommodate an earphone core, the earphone core housing being fixed to the first plug end through plugging, wherein when a user wears the loudspeaker, the ear hook is configured to support the earphone core housing at a position of the user's head without blocking the user's ear canal; and a circuit housing configured to accommodate a control circuit or a battery, the circuit housing being fixed to the second plug end through plugging, and the control circuit or the battery driving the earphone core to vibrate to generate sound.

2. The loudspeaker of claim 1, wherein the ear hook further comprises:

an elastic metal wire;

a lead wire and a fixing sleeve, wherein the fixing sleeve fixes the lead wire to the elastic metal wire; and the protection sleeve being formed on a periphery of the elastic metal wire, the lead wire, the fixing sleeve, the first plug end, and the second plug end by injection molding.

3. The loudspeaker of claim 2, wherein the first plug end and the second plug end are formed at two ends of the elastic metal wire by injection molding, respectively, a first cable-routing channel and a second cable-routing channel are set on the first plug end and the second plug end, respectively, and the lead wire extends along the first cable-routing channel and the second cable-routing channel.

4. The loudspeaker of claim 3, wherein the lead wire is set in the first cable-routing channel and the second cable-routing channel in a threading manner.

5. The loudspeaker of claim 2, wherein there are at least two fixing sleeves, and the fixing sleeves are spaced at intervals along the elastic wire.

6. The loudspeaker of claim 1, wherein a first plug hole is set on the earphone core housing connecting the outer end surface of the earphone core housing, a stop block is set on an inner side wall of the first plug hole, and the first plug hole is connected to the first plug end through clamping.

7. The loudspeaker of claim 6, wherein, the first plug end includes an insertion portion and two elastic hooks;

the insertion portion is at least partially inserted into the first plug hole, and abuts against an outer surface of the stop block;

the two elastic hooks are disposed on a side of the insertion portion facing the inside of the earphone core housing, the two elastic hooks are brought close to each other under an action of an external thrust and the stop block, and elastically restored to be stuck on the inside surface of the stop block after passing through the stop block, fixing the first plug end to the earphone core housing through plugging.

8. The loudspeaker of claim 7, wherein the insertion portion is partially inserted into the first plug hole, and an exposed portion of the insertion portion has a stair-step shape, forming an annular platform spaced at intervals from the outer end surface of the earphone core housing.

9. The loudspeaker of claim 8, wherein the protection sleeve further extends to a side of the annular platform facing the outer end surface of the earphone core housing, and elastically abuts against the earphone core housing for sealing when the earphone core housing is fixed to the first plug end through plugging.

10. The loudspeaker of claim 1, wherein the loudspeaker further includes a fixing member; a second plug hole is set on the circuit housing, and the second plug end is at least partially inserted into the second plug hole and connects the second plug hole through the fixing member.

11. The loudspeaker of claim 10, wherein, the second plug end includes a groove being perpendicular to the insertion direction of the second plug hole, and a through hole corresponding to a position of the groove is set on a first side wall of the circuit housing;

the fixing member includes two pins disposed in parallel and a connecting portion for connecting the pins; and the pins are inserted into the groove from the outside of the circuit housing through the through hole, realizing the fixing of the circuit housing and the second plug end through plugging.

12. The loudspeaker of claim 1, wherein the ear hook further includes a housing protector integrally formed with the protection sleeve, and the housing protector is cladded on a periphery of the circuit housing in a sleeved manner.

13. The loudspeaker of claim 1, wherein the earphone core includes at least a composite vibration apparatus including a vibration board and a second vibration conducting sheet, and the composite vibration apparatus generates the two resonance peaks.

14. The loudspeaker of claim 13, wherein the earphone core further includes at least one voice coil and at least one magnetic circuit system; the voice coil is physically connected to the vibration board, and the magnetic circuit system is physically connected to the second vibration conducting sheet.

15. The loudspeaker of claim 13, wherein a stiffness coefficient of the vibration board is greater than a stiffness coefficient of the second vibration conducting sheet.

16. The loudspeaker of claim 13, wherein, the earphone core further includes a first vibration conducting sheet;

the first vibration conducting sheet is physically connected to the composite vibration apparatus;

the first vibration conducting sheet is physically connected to the earphone core housing; and the first vibration conducting sheet generates another resonance peak.

17. The loudspeaker of claim 16, wherein both the two resonance peaks are within a frequency range audible to a human ear.

18. The loudspeaker of claim 13, wherein the earphone core housing further includes at least one contact surface, and the contact surface is at least partially in direct or indirect contact with a user; and the contact surface has a gradient structure, distributing pressure on the contact surface unevenly.

19. The loudspeaker of claim 18, wherein the gradient structure includes at least one convex or at least one groove, and is located at a center or an edge of the contact surface.

20. The loudspeaker of claim 13, wherein the earphone core housing further includes at least one contact surface, and the contact surface is at least partially in direct or indirect contact with a user;

the contact surface includes at least a first contact surface region and a second contact surface region, and the degree of convexity of the second contact surface region is greater than the degree of convexity of the first contact surface region.

* * * * *